US010001758B2

(12) United States Patent
Yoshida

(10) Patent No.: US 10,001,758 B2
(45) Date of Patent: Jun. 19, 2018

(54) TIME INFORMATION RECEIVER, RADIO WAVE CORRECTION TIMEPIECE, AND TIME CODE TYPE DETERMINATION METHOD

(71) Applicant: Seiko Epson Corporation, Tokyo (JP)

(72) Inventor: Hiroaki Yoshida, Shiojiri (JP)

(73) Assignee: Seiko Epson Corporation (JP)

( * ) Notice: Subject to any disclaimer, the term of this patent is extended or adjusted under 35 U.S.C. 154(b) by 0 days. days.

(21) Appl. No.: 15/435,691

(22) Filed: Feb. 17, 2017

(65) Prior Publication Data

US 2017/0248924 A1 Aug. 31, 2017

(30) Foreign Application Priority Data

Feb. 26, 2016 (JP) ..... 2016-035864

(51) Int. Cl.
*G04R 20/10* (2013.01)
*G04R 20/12* (2013.01)

(52) U.S. Cl.
CPC ..... *G04R 20/12* (2013.01); *G04R 20/10* (2013.01)

(58) Field of Classification Search
CPC ..... G04R 20/10; G04R 20/12
See application file for complete search history.

(56) References Cited

U.S. PATENT DOCUMENTS

2010/0014388 A1* 1/2010 Abe ..... G04R 20/10 368/47
2010/0177602 A1* 7/2010 Abe ..... G04R 20/10 368/47
2010/0177853 A1* 7/2010 Nomura ..... G04R 20/10 375/340
2010/0177854 A1* 7/2010 Nomura ..... G04R 20/10 375/340
2011/0075522 A1* 3/2011 Abe ..... G04R 20/10 368/47
2011/0075523 A1* 3/2011 Abe ..... G04R 20/10 368/47
2011/0255377 A1* 10/2011 Abe ..... G04R 20/10 368/47
2012/0014225 A1* 1/2012 Tokiwa ..... G04R 20/10 368/47

FOREIGN PATENT DOCUMENTS

JP 2013-019723 A 1/2013

* cited by examiner

*Primary Examiner* — Vit W Miska
(74) *Attorney, Agent, or Firm* — Harness, Dickey & Pierce, P.L.C.

(57) ABSTRACT

A time information receiver that receives a standard radio wave containing a time code and analyzes the time code based on a demodulated signal of the standard radio wave includes a falling edge cycle measurement part that measures a falling edge cycle of the demodulated signal over a measurement period set in advance and counts an occurrence in which the falling edge cycle is determined to coincide with any of 400 ms, 700 ms, 1300 ms, and 1600 ms, a low level width measurement part that measures a low level width over the measurement period whenever the falling edge cycle of the demodulated signal occurs and counts an occurrence in which the measured low level width is greater than or equal to a predetermined threshold greater than 300 ms but smaller than 500 ms.

6 Claims, 26 Drawing Sheets

IN A CASE WHERE 200-ms SIGNAL AND 200-ms SIGNAL SUCCESSIVELY OCCUR ⇒ FALLING EDGE CYCLE = 1 SECOND

IN A CASE WHERE 200-ms SIGNAL AND 500-ms SIGNAL SUCCESSIVELY OCCUR ⇒ FALLING EDGE CYCLE = 1300 ms

IN A CASE WHERE 200-ms SIGNAL AND 800-ms SIGNAL SUCCESSIVELY OCCUR ⇒ FALLING EDGE CYCLE = 1600 ms

IN A CASE WHERE 500-ms SIGNAL AND 200-ms SIGNAL SUCCESSIVELY OCCUR ⇒ FALLING EDGE CYCLE = 700 ms

IN A CASE WHERE 500-ms SIGNAL AND 500-ms SIGNAL SUCCESSIVELY OCCUR ⇒ FALLING EDGE CYCLE = 1 SECOND

IN A CASE WHERE 500-ms SIGNAL AND 800-ms SIGNAL SUCCESSIVELY OCCUR ⇒ FALLING EDGE CYCLE = 1300 ms

IN A CASE WHERE 800-ms SIGNAL AND 200-ms SIGNAL SUCCESSIVELY OCCUR ⇒ FALLING EDGE CYCLE = 400 ms

IN A CASE WHERE 800-ms SIGNAL AND 500-ms SIGNAL SUCCESSIVELY OCCUR ⇒ FALLING EDGE CYCLE = 700 ms

IN A CASE WHERE 800-ms SIGNAL AND 800-ms SIGNAL SUCCESSIVELY OCCUR ⇒ FALLING EDGE CYCLE = 1 second IN A CASE WHERE 200-ms SIGNAL AND 200-ms SIGNAL SUCCESSIVELY OCCUR ⇒ RISING EDGE CYCLE = 1 SECOND IN A CASE WHERE 200-ms SIGNAL AND 500-ms SIGNAL SUCCESSIVELY OCCUR ⇒ RISING EDGE CYCLE = 1300 ms IN A CASE WHERE 200-ms SIGNAL AND 800-ms SIGNAL SUCCESSIVELY OCCUR ⇒ RISING EDGE CYCLE = 1600 ms IN A CASE WHERE 500-ms SIGNAL AND 200-ms SIGNAL SUCCESSIVELY OCCUR ⇒ RISING EDGE CYCLE = 700 ms IN A CASE WHERE 500-ms SIGNAL AND 500-ms SIGNAL SUCCESSIVELY OCCUR ⇒ RISING EDGE CYCLE = 1 SECOND IN A CASE WHERE 500-ms SIGNAL AND 800-ms SIGNAL SUCCESSIVELY OCCUR ⇒ RISING EDGE CYCLE = 1300 ms IN A CASE WHERE 800-ms SIGNAL AND 200-ms SIGNAL SUCCESSIVELY OCCUR ⇒ RISING EDGE CYCLE = 400 ms IN A CASE WHERE 800-ms SIGNAL AND 500-ms SIGNAL SUCCESSIVELY OCCUR ⇒ RISING EDGE CYCLE = 700 ms IN A CASE WHERE 800-ms SIGNAL AND 800-ms SIGNAL SUCCESSIVELY OCCUR ⇒ RISING EDGE CYCLE = 1 second

TIME INFORMATION RECEIVER, RADIO WAVE CORRECTION TIMEPIECE, AND TIME CODE TYPE DETERMINATION METHOD

BACKGROUND

1. Technical Field

The present invention relates to a time information receiver, a radio wave correction timepiece, and a time code type determination method.

2. Related Art

Some radio wave correction timepieces used in recent years receive a radio wave containing time information (long-wave standard radio wave), automatically correct the time by using the time information, and display the corrected time.

As a radio wave correction timepiece of this type, there is a disclosed multiband-supporting radio wave timepiece capable of receiving a variety of standard radio waves transmitted in Japan, European countries (Germany, England), North America, and other countries (JP-A-2013-19723).

To determine a time code in a received standard radio wave in a case where the frequency of the standard radio wave differs from those of the other standard radio waves, for example, in the case of DCF77, which is German standard radio wave, the time code of the received radio wave can be determined by identification of the reception frequency.

On the other hand, some of the variety of standard radio waves described above have the same frequency. Specifically, JJY60, which is a standard radio wave transmitted from a transmitting station in Kyushu, Japan, WWVB, which is an American standard radio wave, and MSF, which is a British standard radio wave, are each a radio wave of 60 kHz. Therefore, when a standard radio wave is received with the reception frequency set at 60 kHz, it is necessary to further analyze the time code to determine the type of the radio wave.

To this end, in JP-A-2013-19723 described above, a rising edge cycle measurement part that measures the rising edge cycle of a demodulated signal based on a standard radio wave and a low level width measurement part that measures a low level signal width are provided, and the standard radio wave is measured for, for example, 10 seconds. In a case where the low level width measurement part determines at least once that the low level signal width is 100 ms, the type of the standard radio wave is determined to be MSF. In a case where the count of occurrences in which the low level signal width is 100 ms is 0, the type of the standard radio wave is determined to be JJY60 when the count of occurrences in which the rising edge cycle measurement part determines that the rising edge cycle is 1 second is greater than or equal to a threshold (9 in 10-second measurement, for example), and the type of the standard radio wave is determined to be WWVB when the count described above is fewer than the threshold.

However, in a case where the standard radio wave has a small electric field intensity, or in a case where the waveform of the standard radio wave varies due to noise, the rising edge cycle of the demodulated signal based on the standard radio wave varies, and the number of 1-second-cycle rising edge cycles may be fewer than 9 even when the standard radio wave JJY60 is being received, resulting in wrong determination.

Further, in the case where the standard radio wave has a small electric field intensity, variation in the signal width causes a 200-ms low level signal width signal of the standard radio wave WWVB to narrow, and the 200-ms signal is possibly wrongly determined to be a 100-ms signal.

SUMMARY

An advantage of some aspects of the invention is to provide a time information receiver, a radio wave correction timepiece, and a time code type determination method capable of correctly determining the type of a received standard radio wave.

An aspect of the invention is directed to a time information receiver that receives a standard radio wave containing a time code and analyzes the time code based on a demodulated signal of the standard radio wave, the receiver including a falling edge cycle measurement part that measures a falling edge cycle of the demodulated signal over a measurement period set in advance and counts an occurrence in which the falling edge cycle is determined to coincide with any of 400 ms, 700 ms, 1300 ms, and 1600 ms, a low level width measurement part that measures a low level width over the measurement period whenever the falling edge cycle of the demodulated signal occurs and counts an occurrence in which the measured low level width is greater than or equal to a predetermined threshold greater than 300 ms but smaller than 500 ms, and a determination part that determines a transmitting station that transmits the standard radio wave, wherein when a result of the measurement performed by the low level width measurement part is fewer than 2, the determination part determines that the transmitting station that transmits the standard radio wave is an MSF station.

Among a variety of standard radio waves, since JJY60, WWVB, and MSF use a common frequency of 60 kHz, the type of each of the JJY60, WWVB, and MSF radio waves (transmitting stations) cannot be determined based only on the reception frequency.

A standard radio wave is a serial digital signal in which 1 bit represents 1 second and 60 bits (one minute) form one frame. The pulse width (duty) in each bit represents a marker "M", a position marker "P", and binary "0" and "1".

Among the three types of standard radio wave, since MSF is so configured that the demodulated signal falls when one bit starts, the falling edge of the demodulated signal occurs every 1 second, and the falling edge cycle is 1000 ms. Further, the low level width in each bit is 100 ms (code 0 carried by bitA), 200 ms (code 1 carried by bitA, code 0 carried by bitB), 300 ms (code 1 carried by bitB), or 500 ms (code M). The code M is transmitted only once in 1 minute.

Since JJY60 is so configured that the demodulated signal rises when one bit starts, the rising edge of the demodulated signal occurs every 1 second. In JJY60, since the high-level signal width is 200 ms (code P), 500 ms (code 1), or 800 ms (code 0), the low level width in each bit is 800 ms, 500 ms, or 200 ms. The falling edge cycle in JJY60 is therefore any of 400 ms, 700 ms, 1000 ms, 1300 ms, and 1600 ms in accordance with the arrangement of the codes carried by the bits in the signal.

Since WWVB is so configured that the demodulated signal falls when one bit starts, the falling edge of the demodulated signal occurs every 1 second, and the falling edge cycle is 1000 ms. The low level width in each bit is 200 ms (code 0), 500 ms (code 1), or 800 ms (code P).

When the measurement period set in advance is set to be a period (longer than or equal to 20 seconds but shorter than 60 seconds) that contains at least two codes P in JJY60 and WWVB but does not contain two codes M in MSF, at least two bits each having a low level width greater than or equal to 500 ms are necessarily present in JJY60 and WWVB. On the other hand, in MSF, since a bit having a low level width greater than or equal to 500 ms is only the code M, which is transmitted once in 1 minute, the number of bits having a low level width greater than or equal to 500 ms is 0 or 1 in the measurement period described above or two or more such bits are not present therein. Further, among the bits each having a low level width smaller than 500 ms, the 300-ms code in MSF has the largest signal width.

Therefore, in the aspect of the invention, the threshold to be compared with a measured low level width is set in the low level width measurement part at a value that allows a bit having a low level width greater than or equal to 500 ms and a bit having a low level width smaller than or equal to 300 ms to be distinguished from each other, that is, a predetermined value greater than 300 ms but smaller than 500 ms, for example, 400 ms, which is the central value between 300 ms and 500 ms. An occurrence in which a measured low level width is greater than or equal to the threshold is then counted. As a result, when MSF is received, a bit having a low level width greater than or equal to the threshold described above is 1 at the maximum, and the count value described above is fewer than 2. On the other hand, when JJY60 or WWVB is received, since the code P having a low level width greater than or equal to the threshold described above is transmitted every 10 seconds, and a code-1 bit having a low level width greater than or equal to the threshold described above is further possibly present, the count value described above is at least 2. The determination part can therefore determine that the standard radio wave from an MSF station is being received when the count value provided by the low level width measurement part is fewer than 2.

In this process, the low level width measurement part only needs to evaluate whether the low level width is smaller than or equal to 300 ms or greater than or equal to 500 ms, and the difference between the signal widths is as large as 200 ms, whereby it can be accurately determined that the transmitting station is an MSF station even when the low level width varies to some extent due, for example, to noise. Therefore, since the probability of a case where the transmitting station is wrongly determined to be a station other than an MSF station is small, whereby the reception sensitivity can be maintained. Further, since a transmitting station can be determined by setting the measurement period to be 20 seconds at the minimum, the transmitting station can be determined in a short period.

Another aspect of the invention is directed to a time information receiver that receives a standard radio wave containing a time code and analyzes the time code based on a demodulated signal of the standard radio wave, the receiver including a falling edge cycle measurement part that measures a falling edge cycle of the demodulated signal over a measurement period set in advance and counts an occurrence in which the falling edge cycle is determined to coincide with any of 400 ms, 700 ms, 1300 ms, and 1600 ms, a low level width measurement part that measures a low level width over the measurement period whenever the falling edge cycle of the demodulated signal occurs and counts an occurrence in which the measured low level width is greater than or equal to a predetermined threshold greater than 300 ms but smaller than 500 ms, and a determination part that determines a transmitting station that transmits the standard radio wave, wherein when a result of the measurement performed by the falling edge cycle measurement part is at least 1, the determination part determines that the transmitting station that transmits the standard radio wave is a JJY60 station.

Since the falling edge cycle is 1000 ms in WWVB and MSF, the falling edge cycle measurement part detects no falling edge cycle. On the other hand, the falling edge cycle in JJY60 is 1000 ms in some cases and any of 400 ms, 700 ms, 1300 ms, and 1600 ms in other cases, as described above, the falling edge cycle measurement part detects the falling edge cycle at least once.

The determination part can therefore determine that a standard radio wave from a JJY60 station is being received when the falling edge cycle measurement part detects the falling edge cycle at least once.

In this process, among the cycles to be evaluated by the falling edge cycle measurement part, the cycle closest to 1000 ms, which is the falling edge cycle in WWVB and MSF, is 700 ms and 1300 ms, which differs from 1000 ms by as large as 300 ms, whereby the falling edge cycle in question is not determined to be 700 ms or 1300 ms even when the falling edge cycle varies due, for example, to noise as long as the WWVB or MSF standard radio wave is being received. Therefore, when the falling edge cycle measurement part detects any of 400 ms, 700 ms, 1300 ms, and 1600 ms at least once, it can be accurately determined that JJY60 is being received instead of WWVB or MSF. Further, unlike related art in which the transmitting station is determined by the number of 1-second falling edge cycles, which are present in the radio wave transmitted from every transmitting station, since the determination is made on the basis of the falling edge cycle present only in JJY60, the transmitting station can be accurately determined, and the probability of wrong determination is small, whereby the reception sensitivity can be maintained.

When the measurement period described above is set to be a period containing at least two codes P in JJY60, that is, a period longer than or equal to 20 seconds, at least two bits each having a low level width greater than or equal to 500 ms are necessarily present in JJY60, and a result of the measurement performed by the low level width measurement part is at least 2. Therefore, when the falling edge cycle measurement part detects the falling edge cycle at least once, and further when a result of the measurement performed by the low level width measurement part is at least 2, the determination part can make the determination in consideration of the two results, whereby the transmitting station can be determined to be a JJY60 station with further improved precision. Moreover, since a transmitting station can be determined by setting the measurement period to be 20 seconds at the minimum, the transmitting station can be determined in a short period.

Another aspect of the invention is directed to a time information receiver that receives a standard radio wave containing a time code and analyzes the time code based on a demodulated signal of the standard radio wave, the receiver including a falling edge cycle measurement part that measures a falling edge cycle of the demodulated signal over a measurement period set in advance and counts an occurrence in which the falling edge cycle is determined to coincide with any of 400 ms, 700 ms, 1300 ms, and 1600 ms, a low level width measurement part that measures a low level width over the measurement period whenever the falling edge cycle of the demodulated signal occurs and counts an occurrence in which the measured low level width is greater than or equal to a predetermined threshold greater than 300 ms but smaller than 500 ms, and a determination part that determines a transmitting station that transmits the standard radio wave, wherein when a result of the measurement performed by the falling edge cycle measurement part is 0, and a result of the measurement performed by the low level width measurement part is at least 2, the determination part determines that the transmitting station that transmits the standard radio wave is a WWVB station.

When the measurement period set in advance is set to be a period containing at least two codes P in JJY60 and WWVB, that is, a period longer than or equal to 20 seconds, at least two bits each having a low level width greater than or equal to 500 ms are necessarily present in JJY60 and WWVB. On the other hand, in MSF, since the code M having a low level width greater than or equal to 500 ms is transmitted only once in 1 minute, two or more bits each having a low level width greater than or equal to 500 ms are not present in the measurement period described above. Therefore, when the low level width measurement part detects a low level width greater than or equal to the predetermined threshold greater than 300 ms but smaller than 500 ms (400 ms, for example) at least twice, it can be determined that JJY60 or WWVB is being received. Further, since the falling edge cycle in WWVB and MSF is 1000 ms, the falling edge cycle measurement part detects no falling edge cycle.

Therefore, when a result of the measurement performed by the low level width measurement part is at least 2 and a result of the measurement performed by the falling edge cycle measurement part is 0, the determination part can accurately determine that the standard radio wave from a WWVB station is being received, and the reception sensitivity can be maintained. Further, since a transmitting station can be determined by setting the measurement period to be 20 seconds at the minimum, the transmitting station can be determined in a short period.

Another aspect of the invention is directed to a time information receiver that receives a standard radio wave containing a time code and analyzes the time code based on a demodulated signal of the standard radio wave, the receiver including a rising edge cycle measurement part that measures a rising edge cycle of the demodulated signal over a measurement period set in advance and counts an occurrence in which the rising edge cycle is determined to coincide with any of 400 ms, 700 ms, 1300 ms, and 1600 ms, a low level width measurement part that measures a low level width over the measurement period whenever the rising edge cycle of the demodulated signal occurs and counts an occurrence in which the measured low level width is greater than or equal to a predetermined threshold greater than 300 ms but smaller than 500 ms, and a determination part that determines a transmitting station that transmits the standard radio wave, wherein when a result of the measurement performed by the low level width measurement part is fewer than 2, the determination part determines that the transmitting station that transmits the standard radio wave is an MSF station.

Since JJY60, WWVB, and MSF use a common frequency of 60 kHz, the type of each of the JJY60, WWVB, and MSF radio waves (transmitting stations) cannot be determined based only on the reception frequency. Among the three types of standard radio wave, since JJY60 is so configured that the demodulated signal rises when one bit starts, the rising edge cycle of the demodulated signal is 1000 ms. In JJY60, since the high-level signal width is 200 ms (code P), 500 ms (code 1), or 800 ms (code 0), the low level width in each bit is 800 ms, 500 ms, or 200 ms.

Since WWVB is so configured that the demodulated signal falls when one bit starts, the falling edge of the demodulated signal occurs every 1 second. The low level width in each bit is 200 ms (code 0), 500 ms (code 1), or 800 ms (code P). The rising edge cycle in WWVB is therefore any of 400 ms, 700 ms, 1000 ms, 1300 ms, and 1600 ms in accordance with the arrangement of the codes carried by the bits in the signal.

Since MSF is so configured that the demodulated signal falls when one bit starts, the falling edge of the demodulated signal occurs every 1 second. Further, the low level width in each bit is 100 ms (code 0 carried by bitA), 200 ms (code 1 carried by bitA, code 0 carried by bitB), 300 ms (code 1 carried by bitB), or 500 ms (code M). The rising edge cycle in MSF is therefore any of 600 ms, 700 ms, 800 ms, 900 ms, 1000 ms, 1100 ms, 1200 ms, and 1400 ms in accordance with the arrangement of the codes carried by the bits in the signal.

When the measurement period set in advance is set to be a period that contains at least two codes P in JJY60 and WWVB but does not contain two codes M in MSF (period longer than or equal to 20 seconds but shorter than 60 seconds), at least two bits each having a low level width greater than or equal to 500 ms are necessarily present in JJY60 and WWVB. On the other hand, in MSF, since a bit having a low level width greater than or equal to 500 ms is only the code M, which is transmitted once in 1 minute, two or more bits each having a low level width greater than or equal to 500 ms are not present in the measurement period described above. Further, among the bits each having a low level width smaller than 500 ms, the 300-ms code in MSF has the largest signal width.

Therefore, in the aspect of the invention, the threshold to be compared with a measured low level width part is set in the low level width measurement at a predetermined value greater than 300 ms but smaller than 500 ms, for example, 400 ms, which is the central value between 300 ms and 500 ms. An occurrence in which a measured low level width is greater than or equal to the threshold is then counted. As a result, when MSF is received, a bit having a low level width greater than or equal to the threshold described above is 1 at the maximum, and the count value described above is fewer than 2. On the other hand, when JJY60 or WWVB is received, since the code P having a low level width greater than or equal to the threshold described above is transmitted every 10 seconds, and a code-1 bit having a low level width greater than or equal to the threshold described above is further possibly present, the count value described above is at least 2. The determination part can therefore determine that the standard radio wave from an MSF station is being received when the count value provided by the low level width measurement part is fewer than 2.

In this process, the low level width measurement part only needs to evaluate whether the low level width is smaller than or equal to 300 ms or greater than or equal to 500 ms, and the difference between the signal widths is as large as 200 ms, whereby it can be accurately determined that the transmitting station is an MSF station even when the low level width varies to some extent due, for example, to noise. Therefore, since the probability of a case where the transmitting station is wrongly determined to be a station other than an MSF station is small, whereby the reception sensitivity can be maintained. Further, since a transmitting station can be determined by setting the measurement period to be 20 seconds at the minimum, the transmitting station can be determined in a short period.

Another aspect of the invention is directed to a time information receiver that receives a standard radio wave containing a time code and analyzes the time code based on a demodulated signal of the standard radio wave, the receiver including a rising edge cycle measurement part that measures a rising edge cycle of the demodulated signal over a measurement period set in advance and counts an occurrence in which the rising edge cycle is determined to coincide with any of 400 ms, 700 ms, 1300 ms, and 1600 ms, a low level width measurement part that measures a low level width over the measurement period whenever the rising edge cycle of the demodulated signal occurs and counts an occurrence in which the measured low level width is greater than or equal to a predetermined threshold greater than 300 ms but smaller than 500 ms, and a determination part that determines a transmitting station that transmits the standard radio wave, wherein when a result of the measurement performed by the rising edge cycle measurement part is 0 and a result of the measurement performed by the low level width measurement part is at least 2, the determination part determines that the transmitting station that transmits the standard radio wave is a JJY60 station.

Since the rising edge cycle is 1000 ms in JJY60, the rising edge cycle measurement part detects no rising edge cycle. On the other hand, the rising edge cycle in WWVB is 1000 ms in some cases and any of 400 ms, 700 ms, 1300 ms, and 1600 ms in other cases, as described above, the rising edge cycle measurement part detects the rising edge cycle at least once. The rising edge cycle in MSF is any of 400 ms, 700 ms, 1300 ms, 1600 ms, and a cycle other than these, as described above, the rising edge cycle measurement part detects no rising edge cycle in some cases or detects the rising edge cycle at least once in other cases in accordance with the arrangement of the codes carried by the bits in the signal.

Further, a case where a result of the measurement performed by the low level width measurement part is at least 2 occurs in JJY60 or WWVB, as described above.

The determination part can therefore determine that the standard radio wave from a JJY60 station is being received when a result of the measurement performed by the rising edge cycle measurement part is 0 and a result of the measurement performed by the low level width measurement part is at least 2. Further, unlike related art in which the transmitting station is determined by the number of 1-second rising edge cycles, which are present in the radio wave transmitted from every transmitting station, since the determination is made on the basis of the rising edge cycle not present in JJY60 but present in WWVB, the transmitting station can be accurately determined, and the probability of wrong determination is small, whereby the reception sensitivity can be maintained. Moreover, since a transmitting station can be determined by setting the measurement period to be 20 seconds at the minimum, the transmitting station can be determined in a short period.

Another aspect of the invention is directed to a time information receiver that receives a standard radio wave containing a time code and analyzes the time code based on a demodulated signal of the standard radio wave, the receiver including a rising edge cycle measurement part that measures a rising edge cycle of the demodulated signal over a measurement period set in advance and counts an occurrence in which the rising edge cycle is determined to coincide with any of 400 ms, 700 ms, 1300 ms, and 1600 ms, a low level width measurement part that measures a low level width over the measurement period whenever the rising edge cycle of the demodulated signal occurs and counts an occurrence in which the measured low level width is greater than or equal to a predetermined threshold greater than 300 ms but smaller than 500 ms, and a determination part that determines a transmitting station that transmits the standard radio wave, wherein when a result of the measurement performed by the rising edge cycle measurement part is at least one and a result of the measurement performed by the low level width measurement part is at least 2, the determination part determines that the transmitting station that transmits the standard radio wave is a WWVB station.

When the measurement period set in advance is set to be a period containing at least two codes P in JJY60 and WWVB, that is, a period longer than or equal to 20 seconds, at least two bits each having a low level width greater than or equal to 500 ms are necessarily present in JJY60 and WWVB. On the other hand, in MSF, since the code M having a low level width greater than or equal to 500 ms is transmitted only once in 1 minute, two or more bits each having a low level width greater than or equal to 500 ms are not present in the measurement period described above. Therefore, when the low level width measurement part detects a low level width greater than or equal to the predetermined threshold greater than 300 ms but smaller than 500 ms (400 ms, for example) at least twice, it can be determined that JJY60 or WWVB is being received. Further, since the rising edge cycle in JJy60 is 1000 ms, the rising edge cycle measurement part detects no rising edge cycle, whereas in WWVB, the rising edge cycle is necessarily any of 400 ms, 700 ms, 1300 ms, and 1600 ms, as described above, the rising edge cycle measurement part detects the rising edge cycle at least once.

The determination part can therefore determine that the standard radio wave from a WWVB station is being received when a result of the measurement performed by the rising edge cycle measurement part is at least 1 and a result of the measurement performed by the low level width measurement part is at least 2, whereby the reception sensitivity can be maintained. Further, since a transmitting station can be determined by setting the measurement period to be 20 seconds at the minimum, the transmitting station can be determined in a short period.

A radio wave correction timepiece according to another aspect of the invention includes the time information receiver described above, a time correction part that corrects internal time based on time data acquired by the time information receiver, and a display part that displays the corrected internal time.

According to the aspect of the invention, since the same advantageous effects provided by the time information receiver described above can be provided, the processes carried out by the time information receiver can be simplified, whereby the power consumed by the radio wave correction timepiece can be lowered.

A time code type determination method according to another aspect of the invention is a time code type determination method for receiving a standard radio wave containing a time code and determining a type of the time code based on a demodulated signal of the standard radio wave, the method including a falling edge cycle measurement step of measuring a falling edge cycle of the demodulated signal over a measurement period set in advance and counting an occurrence in which the falling edge cycle is determined to coincide with any of 400 ms, 700 ms, 1300 ms, and 1600 ms, a low level width measurement step of measuring a low level width over the measurement period whenever the falling edge cycle of the demodulated signal occurs and counting an occurrence in which the measured low level width is greater than or equal to a predetermined threshold greater than 300 ms but smaller than 500 ms, and determining that a transmitting station that transmits the standard radio wave is an MSF station when a result of the measurement performed in the low level width measurement step is fewer than 2.

A time code type determination method according to another aspect of the invention is a time code type determination method for receiving a standard radio wave containing a time code and determining a type of the time code based on a demodulated signal of the standard radio wave, the method including a falling edge cycle measurement step of measuring a falling edge cycle of the demodulated signal over a measurement period set in advance and counting an occurrence in which the falling edge cycle is determined to coincide with any of 400 ms, 700 ms, 1300 ms, and 1600 ms, a low level width measurement step of measuring a low level width over the measurement period whenever the falling edge cycle of the demodulated signal occurs and counting an occurrence in which the measured low level width is greater than or equal to a predetermined threshold greater than 300 ms but smaller than 500 ms, and determining that a transmitting station that transmits the standard radio wave is a JJY60 station when a result of the measurement performed in the falling edge cycle measurement step is at least 1.

A time code type determination method according to another aspect of the invention is a time code type determination method for receiving a standard radio wave containing a time code and determining a type of the time code based on a demodulated signal of the standard radio wave, the method including a falling edge cycle measurement step of measuring a falling edge cycle of the demodulated signal over a measurement period set in advance and counting an occurrence in which the falling edge cycle is determined to coincide with any of 400 ms, 700 ms, 1300 ms, and 1600 ms, a low level width measurement step of measuring a low level width over the measurement period whenever the falling edge cycle of the demodulated signal occurs and counting an occurrence in which the measured low level width is greater than or equal to a predetermined threshold greater than 300 ms but smaller than 500 ms, and determining that a transmitting station that transmits the standard radio wave is a WWVB station when a result of the measurement performed in the falling edge cycle measurement step is 0 and a result of the measurement performed in the low level width measurement step is at least 2.

A time code type determination method according to another aspect of the invention is a time code type determination method for receiving a standard radio wave containing a time code and determining a type of the time code based on a demodulated signal of the standard radio wave, the method including a rising edge cycle measurement step of measuring a rising edge cycle of the demodulated signal over a measurement period set in advance and counting an occurrence in which the rising edge cycle is determined to coincide with any of 400 ms, 700 ms, 1300 ms, and 1600 ms, a low level width measurement step of measuring a low level width over the measurement period whenever the rising edge cycle of the demodulated signal occurs and counting an occurrence in which the measured low level width is greater than or equal to a predetermined threshold greater than 300 ms but smaller than 500 ms, and determining that a transmitting station that transmits the standard radio wave is an MSF station when a result of the measurement performed in the low level width measurement step is fewer than 2.

A time code type determination method according to another aspect of the invention is a time code type determination method for receiving a standard radio wave containing a time code and determining a type of the time code based on a demodulated signal of the standard radio wave, the method including a rising edge cycle measurement step of measuring a rising edge cycle of the demodulated signal over a measurement period set in advance and counting an occurrence in which the rising edge cycle is determined to coincide with any of 400 ms, 700 ms, 1300 ms, and 1600 ms, a low level width measurement step of measuring a low level width over the measurement period whenever the rising edge cycle of the demodulated signal occurs and counting an occurrence in which the measured low level width is greater than or equal to a predetermined threshold greater than 300 ms but smaller than 500 ms, and determining that a transmitting station that transmits the standard radio wave is a JJY60 station when a result of the measurement performed in the rising edge cycle measurement step is 0 and a result of the measurement performed in the low level width measurement step is at least 2.

A time code type determination method according to another aspect of the invention is a time code type determination method for receiving a standard radio wave containing a time code and determining a type of the time code based on a demodulated signal of the standard radio wave, the method including a rising edge cycle measurement step of measuring a rising edge cycle of the demodulated signal over a measurement period set in advance and counting an occurrence in which the rising edge cycle is determined to coincide with any of 400 ms, 700 ms, 1300 ms, and 1600 ms, a low level width measurement step of measuring a low level width over the measurement period whenever the rising edge cycle of the demodulated signal occurs and counting an occurrence in which the measured low level width is greater than or equal to a predetermined threshold greater than 300 ms but smaller than 500 ms, and determining that a transmitting station that transmits the standard radio wave is a WWVB station when a result of the measurement performed in the rising edge cycle measurement step is at least 1 and a result of the measurement performed in the low level width measurement step is at least 2.

The time code type determination methods described above can provide the same advantageous effects provided by the time information receiver described above.

A time information receiver according to another aspect of the invention is a time information receiver that receives a standard radio wave containing a time code and analyzes the time code based on a demodulated signal of the standard radio wave, the time information receiver including a falling edge cycle measurement part that measures a falling edge cycle of the demodulated signal over a measurement period set in advance and counts an occurrence in which the falling edge cycle is determined to coincide with a preset cycle other than 1000 ms, a low level width measurement part that measures a low level width over the measurement period whenever the falling edge cycle of the demodulated signal occurs and counts an occurrence in which the measured low level width is greater than or equal to a predetermined threshold greater than 300 ms but smaller than 500 ms, and a determination part that determines a transmitting station that transmits the standard radio wave, wherein the determination part determines that the transmitting station that transmits the standard radio wave is an MSF station when a result of the measurement performed by the low level width measurement part is fewer than 2, determines that the transmitting station that transmits the standard radio wave is a JJY60 station when a result of the measurement performed by the falling edge cycle measurement part is at least 1, and determines that the transmitting station that transmits the standard radio wave is a WWVB station when a result of the measurement performed by the falling edge cycle measurement part is 0 and a result of the measurement performed by the low level width measurement part is at least 2.

A time information receiver according to another aspect of the invention is a time information receiver that receives a standard radio wave containing a time code and analyzes the time code based on a demodulated signal of the standard radio wave, the time information receiver including a rising edge cycle measurement part that measures a rising edge cycle of the demodulated signal over a measurement period set in advance and counts an occurrence in which the rising edge cycle is determined to coincide with a preset cycle other than 1000 ms, a low level width measurement part that measures a low level width over the measurement period whenever the rising edge cycle of the demodulated signal occurs and counts an occurrence in which the measured low level width is greater than or equal to a predetermined threshold greater than 300 ms but smaller than 500 ms, and a determination part that determines a transmitting station that transmits the standard radio wave, wherein the determination part determines that the transmitting station that transmits the standard radio wave is an MSF station when a result of the measurement performed by the low level width measurement part is fewer than 2, determines that the transmitting station that transmits the standard radio wave is a JJY60 station when a result of the measurement performed by the rising edge cycle measurement part is 0 and a result of the measurement performed by the low level width measurement part is at least 2, and determines that the transmitting station that transmits the standard radio wave is a WWVB station when a result of the measurement performed by the rising edge cycle measurement part is at least 1 and a result of the measurement performed by the low level width measurement part is at least 2.

In the time information receivers described above, the preset falling edge cycle and rising edge cycle other than 1000 ms may be set in consideration of possible arrangements of the codes transmitted from the transmitting stations described above and are, for example, 400 ms, 700 ms, 1300 ms, and 1600 ms.

That is, the falling edge cycle measurement part only needs to distinguish MSF and WWVB, in which the falling edge cycle is fixed at 1000 ms, from JJY60, in which falling edge cycles other than 1000 ms are present. Therefore, in JJY60, a falling edge cycle that differs from 1000 ms and possibly occurs, that is, any of 400 ms, 700 ms, 1300 ms, and 1600 ms, may be so set as to coincide with a measured cycle.

Similarly, the rising edge cycle measurement part only needs to distinguish JJY60, in which the rising edge cycle is fixed at 1000 ms, from MSF and WWVB, in which rising edge cycles other than 1000 ms are present. Therefore, in MSF and WWVB, a rising edge cycle that differs from 1000 ms and possibly occurs, that is, any of 400 ms, 700 ms, 1300 ms, and 1600 ms, may be so set as to coincide with a measured cycle.

The time information receivers described above can also provide the same advantageous effects provided by the time information receivers described above.

BRIEF DESCRIPTION OF THE DRAWINGS

The invention will be described with reference to the accompanying drawings, wherein like numbers reference like elements.

DESCRIPTION OF EXEMPLARY EMBODIMENTS

A first embodiment of the invention will be described below with reference to the drawings.

Configuration of Radio Wave Correction Timepiece

Figure 1:
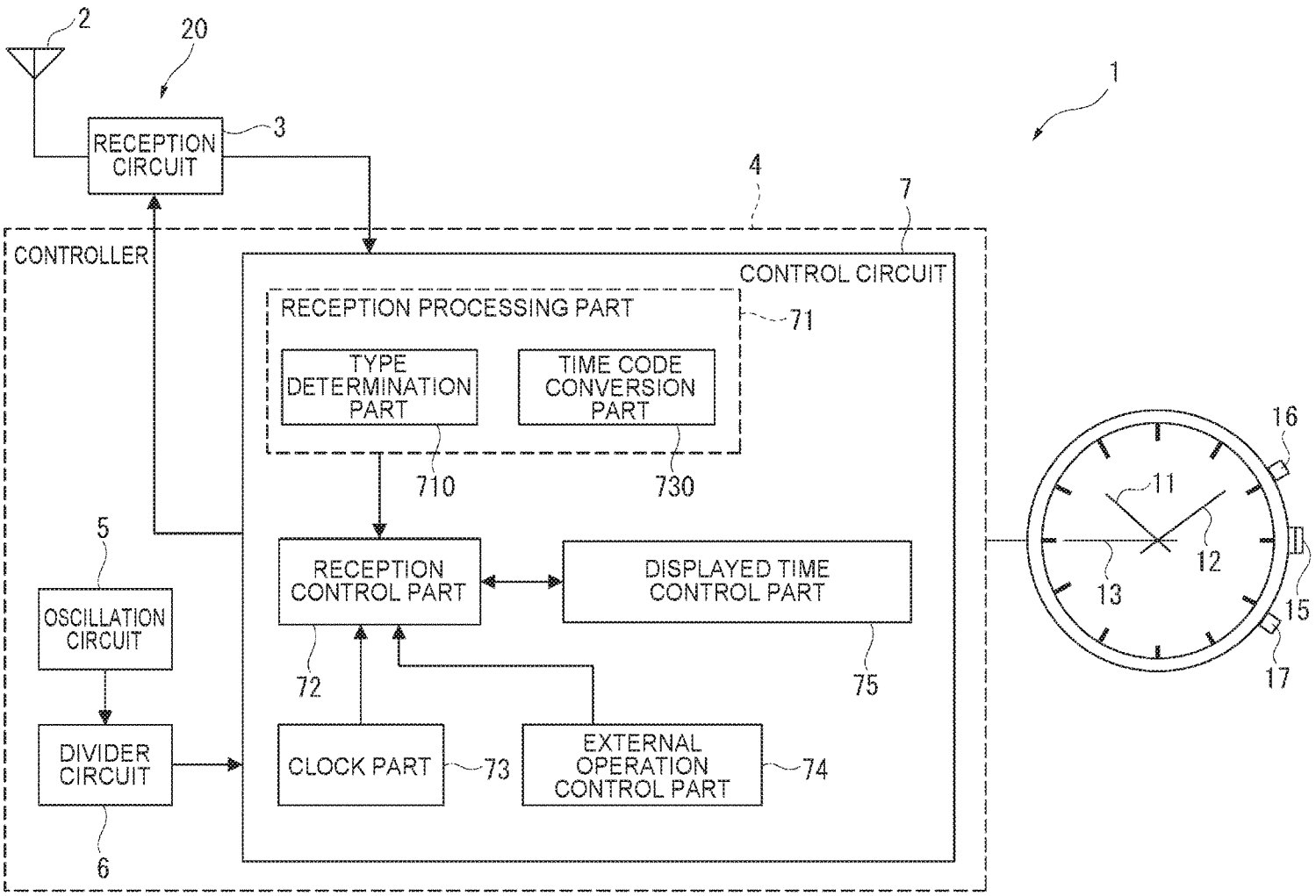
FIG. 1 is a block diagram showing the configuration of a radio wave correction timepiece according to a first embodiment of the invention.

FIG. 1 is a block diagram showing the internal configuration of a radio wave correction timepiece 1.

The radio wave correction timepiece 1 receives a standard radio wave containing time data (time code) and demodulates a TCO signal based on the standard radio wave. The radio wave correction timepiece 1 then encodes the TCO signal to acquire the time data and corrects internal time information on the basis of the time data.

The thus functioning radio wave correction timepiece 1 includes an antenna 2, a reception circuit 3, and a controller 4, as shown in FIG. 1. The radio wave correction timepiece 1 additionally includes an hour hand 11, a minute hand 12, and a second hand 13 as a display part and further includes a crown 15 and buttons 16 and 17 as an operation part.

Among the components described above, the antenna 2, the reception circuit 3, and a reception processing part 71, which is part of the controller 4 and will be described later, form a time information receiver 20 according to an aspect of the invention.

Configuration of Reception Circuit

The reception circuit 3 receives a standard radio wave via the antenna 2 and demodulates a reception signal according to the standard radio wave to generate a TCO (time code out) signal as a demodulated signal on the basis of a control signal inputted from the controller 4. The reception circuit 3 then outputs the generated TCO signal to the controller 4. The thus configured reception circuit 3, although not illustrated in detail, includes a tuner circuit, an amplification circuit, a bandpass filter, an envelope detection circuit, and other components.

The reception circuit 3 according to the present embodiment is configured to be capable of receiving at least standard radio waves having a frequency of 60 kHz, that is, "JJY60," which is a Japanese standard radio wave, "WWVB," which is a standard radio wave used in the United States of America, and "MSF," which is a British standard radio wave.

The reception circuit 3 may be configured to be capable of receiving standard radio waves having other frequencies, for example, "JJY40," which is another Japanese standard radio wave, "DCF77," which is a German standard radio wave, and "BPC," which is a standard radio wave used in the People's Republic of China.

Configuration of Controller

The controller 4 controls the action of the entire radio wave correction timepiece 1 and includes an oscillation circuit 5, a divider circuit 6, and a control circuit 7.

The oscillation circuit 5 and the divider circuit 6 are configured as an operation clock that generates and outputs a reference signal having a predetermined frequency.

Specifically, the oscillation circuit 5, to which a reference signal source that is not shown, such as a quartz vibrator, is connected, causes the reference signal source to oscillate at a high frequency and outputs an oscillation signal generated by the high-frequency oscillation to the divider circuit 6.

The divider circuit 6 divides the oscillation signal inputted thereto. The divider circuit 6 outputs a predetermined reference signal (1-Hz pulse signal, for example) to the control circuit 7.

Configuration of Control Circuit

The control circuit 7 includes a computation processing circuit, such as a CPU, and other components. The control circuit 7 includes a reception processing part 71, a reception control part 72, a clock part 73, an external operation control part 74, and a displayed time control part 75.

The reception processing part 71 determines the type of the received standard radio wave, encodes the TCO signal (time code out) inputted from the reception circuit 3 to acquire time data, and outputs the time data to the reception control part 72. The configuration of the reception processing part 71 will be described later in detail.

The reception control part 72 outputs a control signal to the reception circuit 3 to control the reception action of the reception circuit 3. The reception control part 72 typically causes the reception circuit 3 to perform the reception action when the time clocked by the clock part 73 reaches reception process time set in advance (2 AM, for example).

In a case where the time data inputted from the reception processing part 71 is incorrect, the reception control part 72 causes the reception circuit 3 to perform the reception process again after a period set in advance elapses. For example, the reception control part 72 causes the reception circuit 3 to perform the reception process again in a case where the time obtained by conversion of the time data is realistically impossible time, such as 25 o'clock or 65 minutes, or a case where incorrect time data is acquired on the basis of the parity contained in the time data.

When appropriate time data is acquired, the reception control part 72 corrects time clocked by the clock part 73 (internal time) on the basis of the time data. In response to the time correction, the reception control part 72 outputs a control signal to the displayed time control part 75 to cause it to correct the displayed time. That is, the reception control part 72 corresponds to a time correction part according to an aspect of the invention.

The clock part 73 clocks the internal time on the basis of the reference signal inputted from the divider circuit 6. The clock part 73, to which time information based on the time data from the reception control part 72, corrects the internal time being clocked in accordance with the time information for time adjustment.

The external operation control part 74 detects operation performed on the crown 15 and the buttons 16 and 17 and instructs control according to the operation. Examples of the control include setting the type of the standard radio wave received with the antenna 2 and carrying out a manual reception process of receiving a standard radio wave and correcting the internal time (forced reception process).

The displayed time control part 75 controls and drives indicating hands formed of the hour hand 11, the minute hand 12, and the second hand 13 described above on the basis of a control signal outputted from the reception control part 72. Specifically, the displayed time control part 75 controls an electric motor that drives each of the indicating hands on the basis of the internal time clocked by the clock part 73. That is, in the present embodiment, the displayed time control part 75, the hour hand 11, the minute hand 12, and the second hand 13 form a display part according to an aspect of the invention.

In the present embodiment, the indicating hands are used to display the time, but not necessarily, and any of a variety of displays, such as a liquid crystal display, an organic EL (electroluminescence) display, and an electrophoresis display, may be used to display the time.

Configuration of Reception Processing Part

The reception processing part 71 includes a type determination part 710, which determines the type of the demodulated signal inputted from the reception circuit 3 (type of received standard radio wave, that is, type of standard radio wave frequency station (transmitting station)), and a time code conversion part 730, which encodes the demodulated signal in accordance with the type of the radio wave determined by the type determination part 710 to convert (analyze) the demodulated signal into a time code.

Figure 2:
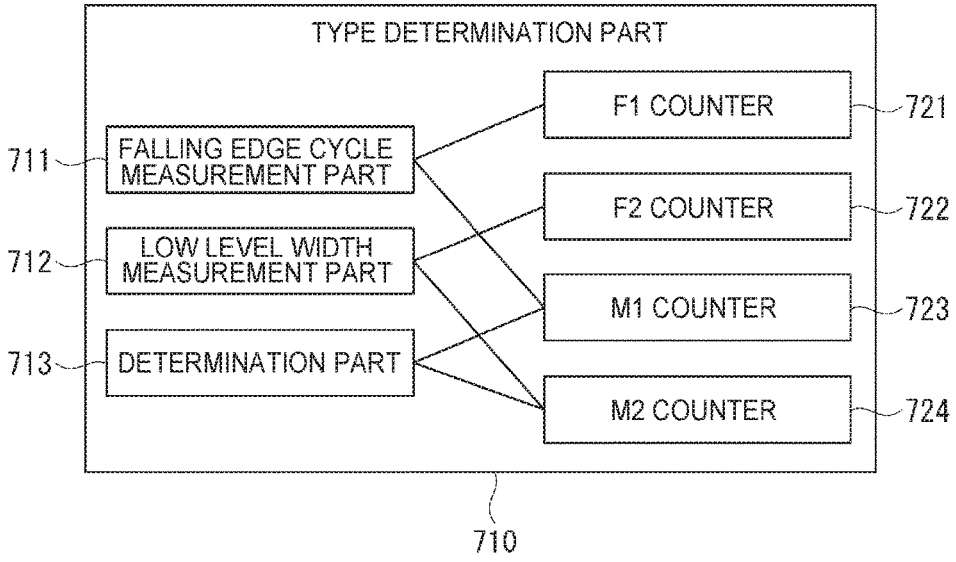
FIG. 2 is a block diagram showing he configuration of a type determination part in the first embodiment.

The type determination part 710 includes a falling edge cycle measurement part 711, which measures the falling edge cycle of the demodulated signal (TCO signal) inputted from the reception circuit 3, a low level width measurement part 712, which measures a low level width in each falling edge cycle of the demodulated signal, a determination part 713, which determines the type of the time code contained in the received standard radio wave on the basis of results of the measurement performed by the falling edge cycle measurement part 711 and the low level width measurement part 712, an F1 counter 721, an F2 counter 722, an M1 counter 723, and an M2 counter 724, as shown in FIG. 2.

The F1 counter 721 is a counter that counts a value representing the measurement of the falling edge cycle measured by the falling edge cycle measurement part 711. The falling edge of the demodulated signal means that when the waveform of the demodulated signal is sampled, for example, at 64 Hz, High (high level, hereinafter abbreviated to "H" in some cases) occurred in the preceding sampling and Low (low level, hereinafter abbreviated to "L" in some cases) occurs in the current sampling. The falling edge cycle measurement part 711 therefore does not determine that a falling edge occurs when the signal level in the preceding sampling is the same as that in the current sampling or when "L" occurred in the preceding sampling and "H" occurs in the current sampling.

The F2 counter 722 is a counter that counts a value representing the measurement of the low level width measured by the low level width measurement part 712.

The M1 counter 723 is a counter that counts an occurrence in which the falling edge cycle measurement part 711 determines that the falling edge cycle of the demodulated signal is equal to a cycle set in advance. In the present embodiment, the M1 counter 723 counts an occurrence in which the falling edge cycle measurement part 711 determines that the falling edge cycle of the demodulated signal is any of 400 ms, 700 ms, 1300 ms, and 1600 ms. That is, the M1 counter 723 counts an occurrence in which the falling edge cycle measurement part 711 determines that the falling edge cycle of the demodulated signal coincides with any of the falling edge cycles set in advance other than 1000 ms.

The M2 counter 724 is a counter that counts an occurrence in which the low level width measurement part 712 determines that the low level width of the demodulated signal is greater than or equal to a predetermined threshold or greater than or equal to 400 ms, which is the threshold in the present embodiment.

Process of Determining Transmitting Station (Standard Radio Wave Frequency Station)

Figure 3:
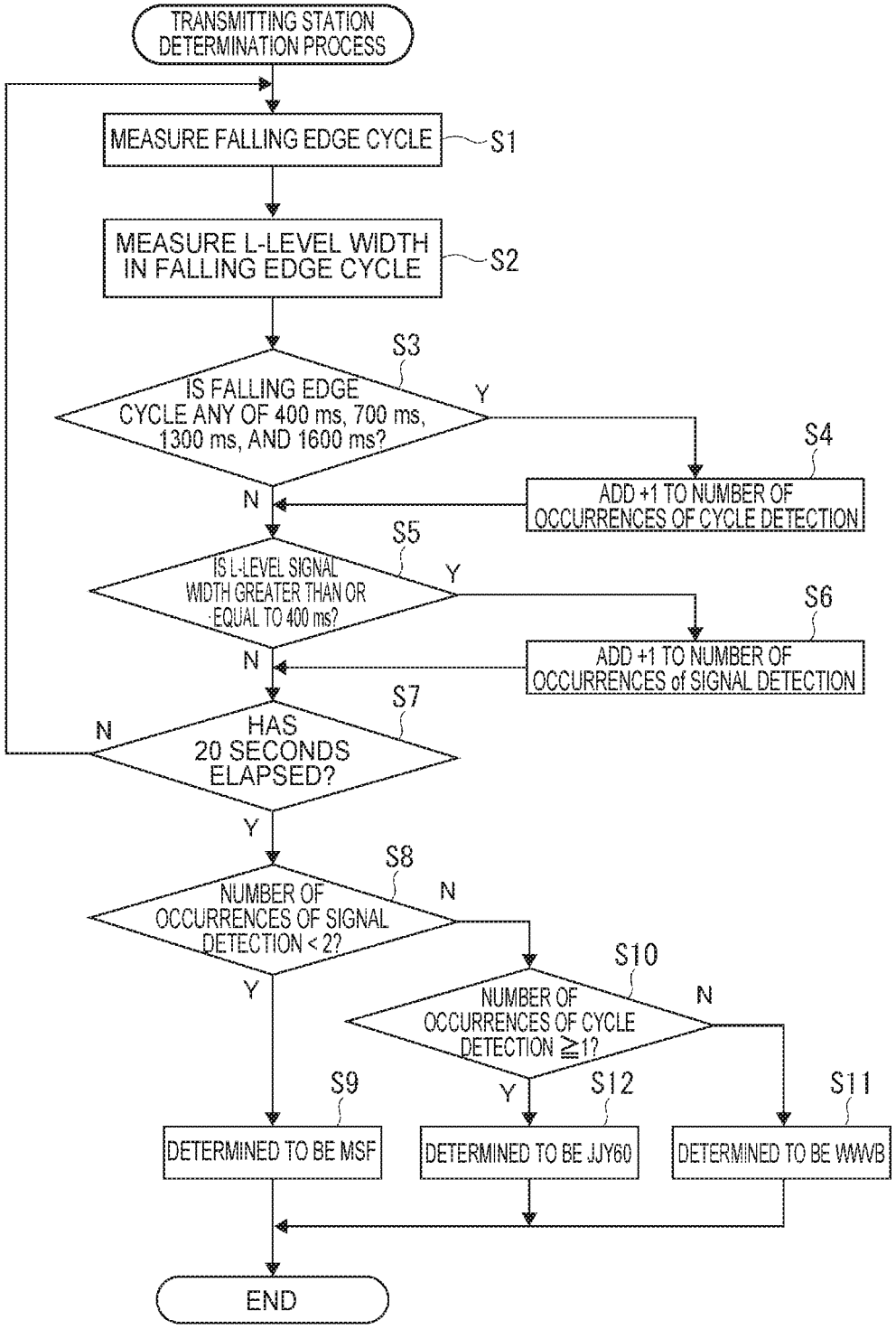
FIG. 3 is a flowchart showing a transmitting station determination process in the first embodiment.

The process of determining a transmitting station (hereinafter referred to as "transmitting station determination process") performed by the type determination part 710 will next be described with reference to the flowchart of FIG. 3.

The transmitting station determination process is a time code type determination method according to an aspect of the invention and carried out in a case where the reception frequency is set at 60 kHz in the reception circuit 3. In the present embodiment, the waveform of the demodulated signal is sampled at 64 Hz.

When the transmitting station determination process is initiated, the falling edge cycle measurement part 711 carries out the process of measuring the falling edge cycle (step S1, which is falling edge cycle measurement step). That is, having detected a falling edge of the demodulated signal, the falling edge cycle measurement part 711 measures the period that elapses until a falling edge is detected next. In the present embodiment, the elapsed period is measured by counting an occurrence of the sampling, and the count value (falling edge cycle) is provided by the F1 counter 721.

The low level width measurement part 712 carries out the process of measuring the low level width in the falling edge cycle (step S2, which is low level width measurement step). That is, the low level width measurement part 712 measures the width (temporal length) where the demodulated signal has the low level in the period from the falling edge detected by the falling edge cycle measurement part 711 to the following falling edge. In the present embodiment, the low level width is measured by counting an occurrence of the sampling, and the count value (low level width) is provided by the F2 counter 722.

The falling edge cycle measurement part 711 then determines whether the measured falling edge cycle is any of 400 ms, 700 ms, 1300 ms, and 1600 ms (step S3).

Figure 4:
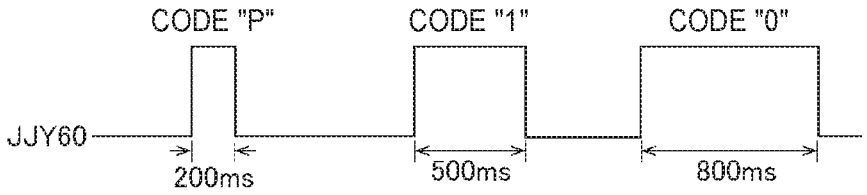
FIG. 4 shows the signal waveform of each bit in JJY60.
Figure 5:
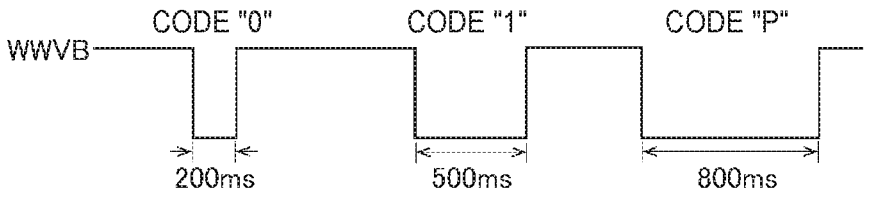
FIG. 5 shows the signal waveform of each bit in WWVB.
Figure 6:
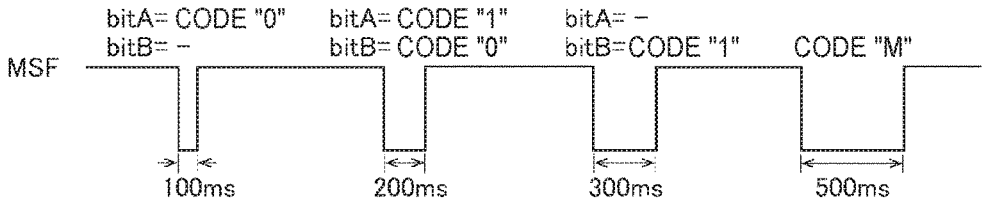
FIG. 6 shows the signal waveform of each bit in MSF.

FIGS. 4 to 6 show the signal waveform of each code in JJY60, WWVB, and MSF.

In JJY60, since the demodulated signal rises when each bit of the signal starts, the rising edge occurs at 1-second intervals, as shown in FIG. 4. The falling edge cycle in JJY60 therefore varies in accordance with the type of the code in each bit.

Figure 7:
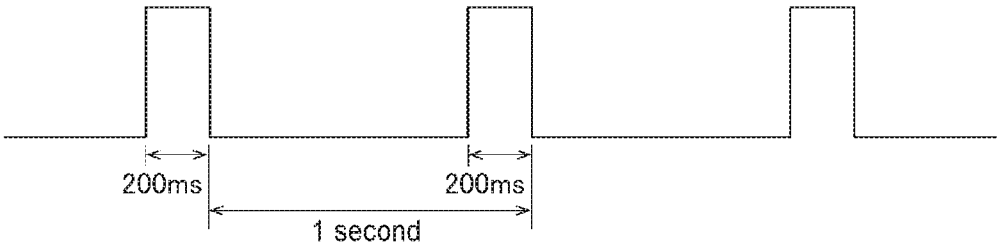
FIG. 7 is a timing chart for describing the falling edge cycle in a case where a code-P signal successively occurs in JJY60.
Figure 8:
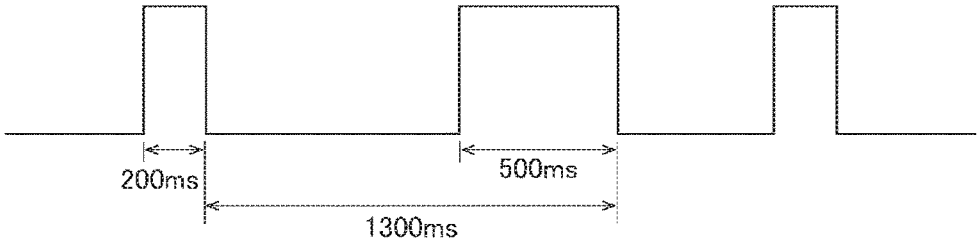
FIG. 8 is a timing chart for describing the falling edge cycle in a case where the code-P signal and a code-1 signal successively occur in JJY60.
Figure 9:
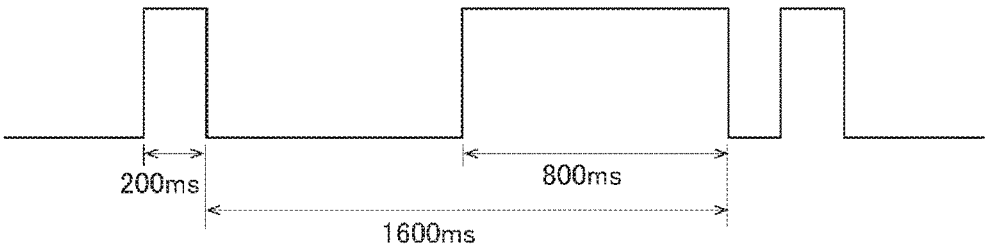
FIG. 9 is a timing chart for describing the falling edge cycle in a case where the code-P signal and a code-0 signal successively occur in JJY60.

For example, when the 200-ms signal (code-P signal) successively occurs, the falling edge cycle is 1 second (1000 ms), as shown in FIG. 7. When the 200-ms signal and the 500-ms signal (code-1 signal) successively occur, the falling edge cycle is 1300 ms, as shown in FIG. 8. When the 200-ms signal and the 800-ms signal (code-0 signal) successively occur, the falling edge cycle is 1600 ms, as shown in FIG. 9.

Figure 10:
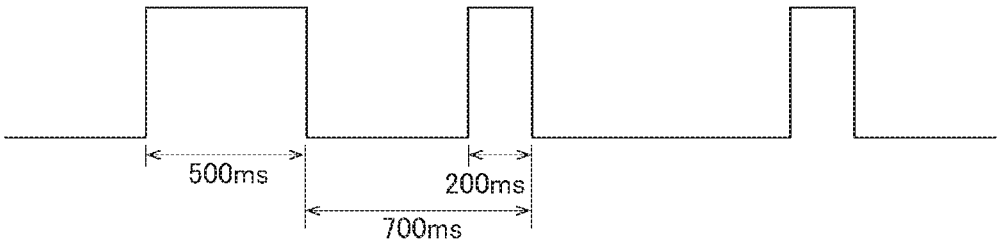
FIG. 10 is a timing chart for describing the falling edge cycle in a case where the code-1 signal and the code-P signal successively occur in JJY60.
Figure 11:
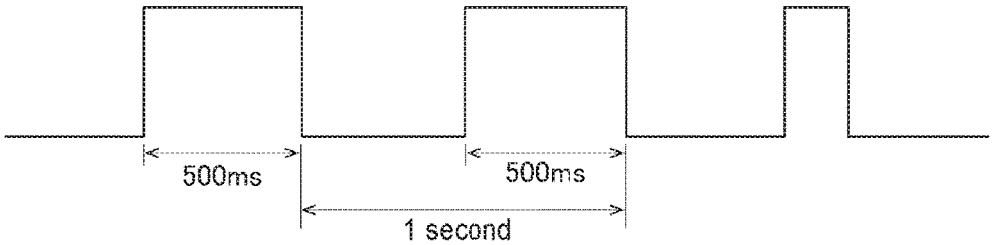
FIG. 11 is a timing chart for describing the falling edge cycle in a case where the code-1 signal and another code-1 signal successively occur in JJY60.
Figure 12:
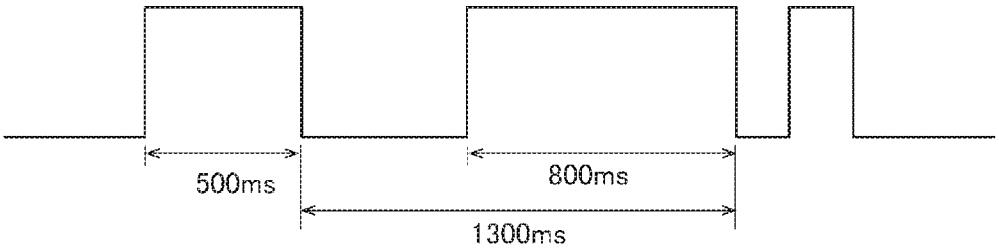
FIG. 12 is a timing chart for describing the falling edge cycle in a case where the code-1 signal and the code-0 signal successively occur in JJY60.

When the 500-ms signal and the 200-ms signal successively occur, the falling edge cycle is 700 ms, as shown in FIG. 10. When the 500-ms signal and another 500-ms signal successively occur, the falling edge cycle is 1000 ms, as shown in FIG. 11. When the 500-ms signal and the 800-ms signal successively occur, the falling edge cycle is 1300 ms, as shown in FIG. 12.

Figure 13:
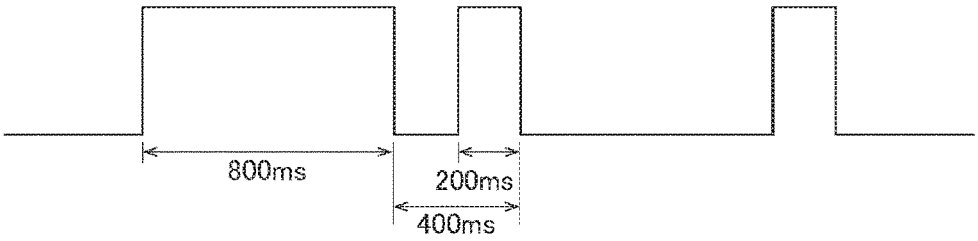
FIG. 13 is a timing chart for describing the falling edge cycle in a case where the code-0 signal and the code-P signal successively occur in JJY60.
Figure 14:
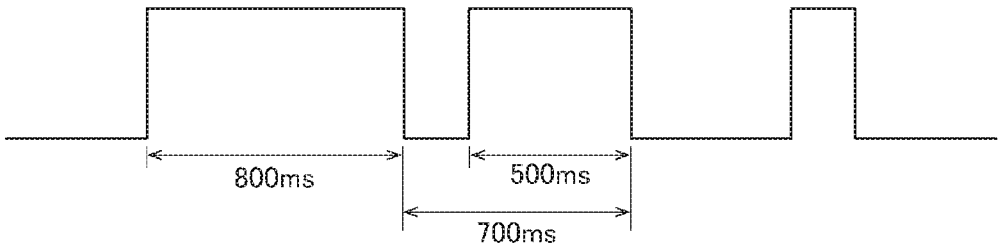
FIG. 14 is a timing chart for describing the falling edge cycle in a case where the code-0 signal and the code-1 signal successively occur in JJY60.
Figure 15:
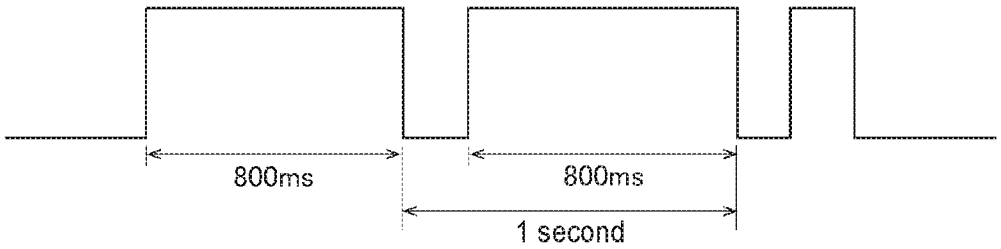
FIG. 15 is a timing chart for describing the falling edge cycle in a case where the code-0 signal and another code-0 signal successively occur in JJY60.

When the 800-ms signal and the 200-ms signal successively occur, the falling edge cycle is 400 ms, as shown in FIG. 13. When the 800-ms signal and the 500-ms signal successively occur, the falling edge cycle is 700 ms, as shown in FIG. 14. When the 800-ms signal and another 800-ms signal successively occur, the falling edge cycle is 1000 ms, as shown in FIG. 15.

The falling edge cycle that occurs in JJY60 is therefore any of 400 ms, 700 ms, 1000 ms, 1300 ms, and 1600 ms.

On the other hand, in WWVB and MSF, since the demodulated signal falls when each bit of the signal starts, as shown in FIGS. 5 and 6, the falling edge cycle is 1 second (1000 ms).

Therefore, in the case where JJY60 is received, a falling edge cycle other than 1000 ms is detected in some cases. In this case, the falling edge cycle measurement part 711 determines the result of step S3 to be "Yes" and adds +1 to the count value of the M1 counter 723, which counts the occurrence of cycle detection (step S4).

On the other hand, since the falling edge cycle is 1 second in the case where the same code successively occurs in JJY60 and in the case where WWVB or MSF is received, the falling edge cycle is 1 second, and the falling edge cycle measurement part 711 therefore determines the result of step S3 to be "No" and does not update the M1 counter 723.

In the present embodiment, the falling edge cycle measurement part 711 determines whether the falling edge cycle is any of the cycles described above on the basis of the count value of the F1 counter 721. In the case where the sampling frequency is 64 Hz, the sampling occurs every 1000 ms/64=15.625 ms. Therefore, when the count value is "22", the falling edge cycle is 15.625×22=343.75 ms, and when the count value is "30", the falling edge cycle is 468.75 ms. The range of the count value from 22 to 30 corresponds to the range of 125 ms from 343.75 to 468.75 ms, and 400 ms belongs to the 125-ms range. The condition under which the falling edge cycle measurement part 711 determines that the falling edge cycle coincides with 400 ms is therefore so set that the count value of the F1 counter 721, which is a result of the measurement of the falling edge cycle, is greater than or equal to 22 but fewer than or equal to 30.

Similarly, the condition under which the falling edge cycle measurement part 711 determines that the falling edge cycle coincides with 700 ms is so set that the count value of the F1 counter 721 is greater than or equal to 41 but fewer than or equal to 49. The condition under which the falling edge cycle measurement part 711 determines that the falling edge cycle coincides with 1300 ms is so set that the count value described above is greater than or equal to 79 but fewer than or equal to 87. The condition under which the falling edge cycle measurement part 711 determines that the falling edge cycle coincides with 1600 ms is so set that the count value described above is greater than or equal to 98 but fewer than or equal to 106.

The low level width measurement part 712 then evaluates whether a low level width measured in the falling edge cycle period is greater than or equal to a threshold set in advance (step S5). The threshold is a predetermined value greater than 300 ms but smaller than 500 ms and is set at 400 ms in the present embodiment. The low level width measurement part 712 can therefore evaluate whether or not a bit carrying a code having a low level width greater than or equal to 500 ms has been received by evaluating whether the measured low level width is greater than or equal to 400 ms.

In JJY60, codes having a low level width greater than or equal to 500 ms in a falling edge cycle are the code P (having a low level width of 800 ms) and the code 1 (having a low level width of 500 ms), as shown in FIG. 4. In WWVB, such codes are the code P (having a low level width of 800 ms) and the code 1 (having a low level width of 500 ms), as shown in FIG. 5. In MSF, such a code is the code M (having a low level width of 500 ms), as shown in FIG. 6.

Therefore, in a case where a bit carrying the code P or the code 1 is received in JJY60 or WWVB and in a case where the code M is received in MSF, the low level width measurement part 712 determines the result of step S5 to be "Yes." In this case, the low level width measurement part 712 adds +1 to the count value of the M2 counter 724, which counts an occurrence in which a signal having a low level width greater than or equal to 400 ms is detected (step S6).

On the other hand, in the case where a bit carrying the code 1 is received in JJY60 or WWVB and in the case where a bit carrying a code other than the code M is received in MSF, the detected low level width is 300 ms or smaller. In this case, the low level width measurement part 712 determines the result of step S5 to be "No" and does not update the M2 counter 724.

As a method for evaluating whether the low level width is greater than or equal to 400 ms, for example, in a case where the low level width is measured at the sampling frequency described above, the low level width measurement part 712 may count an occurrence of the sampling as long as the low level state is continuously detected and determine the result of step S5 to be "Yes" when the count value is, for example, greater than or equal to "26" (that is, low level width is greater than or equal to 15.625 ms×26=406.25 ms), whereas determining the result of step S5 to be "No" when the count value is fewer than "26".

The falling edge cycle measurement part 711 then evaluates whether or not the falling edge cycle has lasted for 20 seconds (step S7). That is, in the present embodiment, the determination process is carried out by use of a demodulated signal that lasts for 20 seconds, which is a measurement period set in advance. The reason why the determination process is carried out by use of a demodulated signal that lasts for 20 seconds is that a code-P signal is transmitted every 10 seconds in JJY60 and WWVB, whereas a code-M signal is transmitted every 1 minute in MSF.

That is, the low level width is greater than or equal to 400 ms in MSF only when a code-M signal is received, and the code-M signal is transmitted only once in 1 minute. Therefore, in a demodulated signal that lasts for 20 seconds, the number of code-M signals is 0 or 1, and the counter value of the M2 counter 724 is 1 at the maximum.

On the other hand, in JJY60 and WWVB, since a code-P signal is transmitted every 10 seconds, in a demodulated signal that lasts for 20 seconds, the number of code-P signals is 2. Further, since a code-1 signal may further possibly be contained in the demodulated signal, the counter value of the M2 counter 724 is at least 2.

Therefore, in a demodulated signal that lasts for 20 seconds, the number of signals having a low level width greater than or equal to 400 ms is 0 or 1 in MSF and at least 2 in JJY60 and WWVB. As a result, use of a demodulated signal that lasts for 20 seconds in the determination allows MSF to be distinguished from JJY60 and WWVB.

When a result of the evaluation in step S7 is No, the falling edge cycle measurement part 711 repeats the processes in steps S1 to S7.

When a result of the evaluation in step S7 is "Yes," the determination part 713 carries out the process of determining the type of the radio wave being received (transmitting station).

That is, the determination part 713 first evaluates whether the counter value of the M2 counter 724 (count of occurrences of signal detection) is fewer than "2" (step S8). The M2 counter 724 counts up whenever a signal having a low level width greater than or equal to 400 ms, that is, a signal having a low level width set to be greater than or equal to 500 ms in MSF, JJY60, and WWVB is detected. As described above, the M2 counter 724 is incremented by a value fewer than 2 in a case where MSF is received for 20 seconds, whereas the M2 counter 724 is incremented by a value greater than or equal to 2 in a case where JJY60 or WWVB is received for 20 seconds.

Therefore, when a result of the evaluation in step S8 is "Yes," that is, when the counter value of the M2 counter 724 is fewer than "2", the determination part 713 determines that the station from which the radio wave is being received is MSF (step S9).

On the other hand, in the case of JJY60 and WWVB, when the code P is received, the low level width is greater than or equal to 400 ms, and when the reception lasts for 20 seconds, the M2 counter 724 counts up at least twice and is therefore incremented to at least "2", as described above. A result of the evaluation in step S8 is therefore "No." The determination part 713 then evaluates whether the counter value of the M1 counter 723 is greater than or equal to "1", which is a threshold (step S10).

At this point, the M1 counter 723 shows the count of occurrences in which the interval between the falling edges of the signal has been determined to be any of 400 ms, 700 ms, 1300 ms, and 1600 ms. Therefore, in the case where a WWVB signal, which falls when each bit starts, is received, the falling edge cycle is 1000 ms, and the M1 counter 723 does not count up so that the count value thereof remains "0". Therefore, when a result of the evaluation in step S10 is "No," that is, the counter value of the M1 counter 723 (count of occurrences of cycle detection) is "0", the determination part 713 determines that the station from which the radio wave is being received is a WWVB station (step S11).

On the other hand, in the case of JJY60, in which the falling edge cycle varies in accordance with the code carried by each bit, the falling edge cycle is 1000 ms in some cases and is any of 400 ms, 700 ms, 1300 ms, and 1600 ms in other cases. In particular, since any of 400 ms, 700 ms, 1300 ms, and 1600 ms is necessarily present in the 20-second measurement period, the counter value of the M1 counter 723 is greater than or equal to "1". Therefore, when a result of the evaluation in step S10 is "Yes," that is, the counter value of the M1 counter 723 (count of occurrences of cycle detection) is greater than or equal to "1", the determination part 713 determines that the station from which the radio wave is being received is JJY60 (step S12).

The type determination part 710, which carries out the processes described above, determines the type of a received radio wave, that is, a standard radio wave frequency station. Table 1 shows the counter value of the M1 counter 723, which counts an occurrence in which the falling edge cycle is determined to be any of 400 ms, 700 ms, 1300 ms, and 1600 ms, the counter value of the M2 counter 724, which counts an occurrence in which the low level width is determined to be greater than or equal to the predetermined threshold (400 ms), and methods for the determination.

TABLE 1

| Transmitting station | Value of M1 counter | Value of M2 counter | Determination method |
|---|---|---|---|
| MSF | 0 | Fewer than 2 (for 20 seconds) | The count of occurrences in which L-level width is detected is fewer than 2 |
| JJY60 | at least 1 | At least 2 (for 20 seconds) | The count of occurrences in which cycle is detected is at least 1 |
| WWVB | 0 | At least 2 (for 20 seconds) | The count of occurrences in which cycle is detected is 0 and the count of occurrences in which L-level width is detected is at least 2 |

Once the type of the received radio wave can be determined, the reception control part 72 keeps the reception and the time code conversion part 730 decodes the time code carried by the acquired 60 bits to convert the time code into time information on the basis of the time code format of the determined radio wave.

The time information is transmitted to the reception control part 72, which uses the received time to correct the internal time and further corrects the displayed time via the displayed time control part 75, as described above.

Advantageous Effects Provided by First Embodiment

The radio wave correction timepiece 1 according to the first embodiment described above provides the following advantageous effects.

The radio wave correction timepiece 1, in which the type determination part 710 simply receives a signal that lasts for the measurement period set in advance (specifically, 20 seconds so set as to contain the code P twice in JJY60 and WWVB but contain the code M only once in MSF), can determine which of the three types of radio wave having the same frequency (60 kHz) the radio wave being received belongs to. The processing period required for determination of the type of the received radio wave can therefore be shortened. That is, the measurement period set at 20 seconds at the shortest (but shorter than 60 seconds) allows determination of the transmitting station, whereby the transmitting station can be determined in a short period.

Further, since the low level width measurement part 712 evaluates whether or not a measured low level width is greater than or equal to the predetermined threshold (400 ms), the low level width measurement part 712 can precisely distinguish MSF, in which a signal having a low level signal width greater than or equal to 500 ms (code M) is received only at once at the maximum in the 20-second reception, from JJY60 and WWVB, in which a signal having a low level signal width greater than or equal to 500 ms (code P, code 1) is received at least twice in the 20-second reception. In particular, the low level width measurement part 712 only needs to determine whether a signal having a low level width greater than or equal to 500 ms or any other signal (having a low level width of 100 ms, 200 ms, or 300 ms) has been received. Since the difference in the signal width is as large as 200 ms, setting the threshold, for example, at 400 ms allows MSF to be accurately distinguished from JJY60 and WWVB even when the low level width varies to some extent due, for example, to noise.

Further, since the threshold used in the low level width measurement part 712 is set at 400 ms, which is the central value between the low level width of a signal having a low level width of 300 ms and the low level width of a signal having a low level width of 500 ms, the threshold is separate by as large as 100 ms from the low level widths of the signals having low level widths of 500 ms and 300 ms, whereby the determination is precisely made even when the low level widths of the signals vary due, for example, to noise. As a result, an MSF station and a JJY60 station or a WWVB station can be accurately distinguished from each other, whereby the reception sensitivity can be maintained.

Further, among the cycles to be evaluated by the falling edge cycle measurement part 711, the cycle closest to 1000 ms, which is the falling edge cycle in WWVB and MSF, is 700 ms and 1300 ms, which differs from 1000 ms by as large as 300 ms, whereby the falling edge cycle measurement part 711 does not determine the falling edge cycle in question to be 700 ms or 1300 ms even when the falling edge cycle varies due, for example, to noise as long as the WWVB or MSF standard radio wave is being received. Therefore, when the falling edge cycle measurement part 711 detects any of 400 ms, 700 ms, 1300 ms, and 1600 ms at least once, it can be accurately determined that JJY60 is being received instead of WWVB or MSF. That is, since the transmitting station is not determined by the number of 1-second falling edge cycles, which are present in the radio wave transmitted from every transmitting station, but the determination is made by the falling edge cycle present only in JJY60, the transmitting station can be accurately determined, and the probability of wrong determination is small, whereby the reception sensitivity can be maintained.

In the present embodiment, since the type of a radio wave can be determined only by measuring the falling edge cycle and the low level width of a received signal, updating the counter values of the counters 721 to 724, and evaluating the counter values, whereby no complicated calculation process is required.

Therefore, since the process of determining the type of a radio wave can be carried out in a short period and simplified, power consumption required for the determination process can be lowered, and hence the power consumed by the radio wave correction timepiece 1 can be lowered.

In each of the measurement of the cycle of the falling edge interval performed by the falling edge cycle measurement part 711 and the measurement of the low level width performed by the low level width measurement part 712, the length of a period is measured by counting an occurrence of the sampling, whereby the period can be measured more readily than in a case where a timer or any other tool is used.

Second Embodiment

Figure 16:
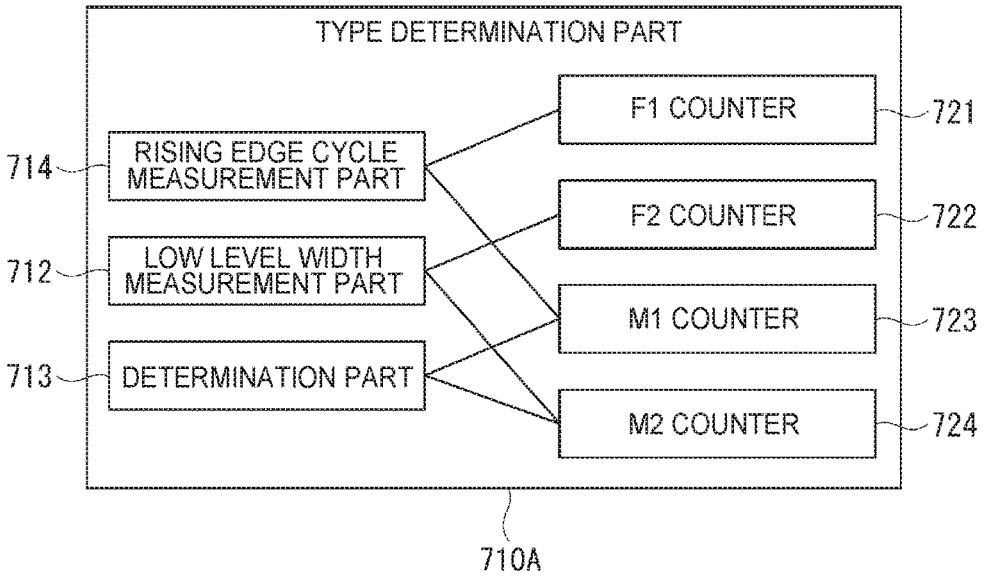
FIG. 16 is a block diagram showing he configuration of a type determination part in a second embodiment.

A second embodiment of the invention will next be described. In the second embodiment, a type determination part 710A shown in FIG. 16 is used to carry out a transmitting station determination process shown in FIG. 17. In the second embodiment, the same configurations and processes as those in the first embodiment described above have the same reference characters and will not be described.

The type determination part 710A in the present embodiment includes a rising edge cycle measurement part 714 in place of the falling edge cycle measurement part 711 in the first embodiment described above.

The rising edge cycle measurement part 714 measures the rising edge cycle of the demodulated signal (TCO signal) inputted from the reception circuit 3. The measured value is counted with the F1 counter 721.

The rising edge cycle measurement part 714 further evaluates whether the measured rising edge cycle coincides with any of 400 ms, 700 ms, 1300 ms, and 1600 ms. The count of occurrences in which the rising edge cycle coincides with any of 400 ms, 700 ms, 1300 ms, and 1600 ms is counted with the M1 counter 723. That is, the M1 counter 723 counts an occurrence in which the rising edge cycle measurement part 714 determines that a preset rising edge cycle other than 1000 ms has occurred.

The low level width measurement part 712, the determination part 713, the F2 counter 722, and the M2 counter 724 in the type determination part 710A have the same configurations as those in the first embodiment described above.

The transmitting station determination process (time code type determination method) in the second embodiment will be described with reference to the flowchart of FIG. 17.

Figure 17:
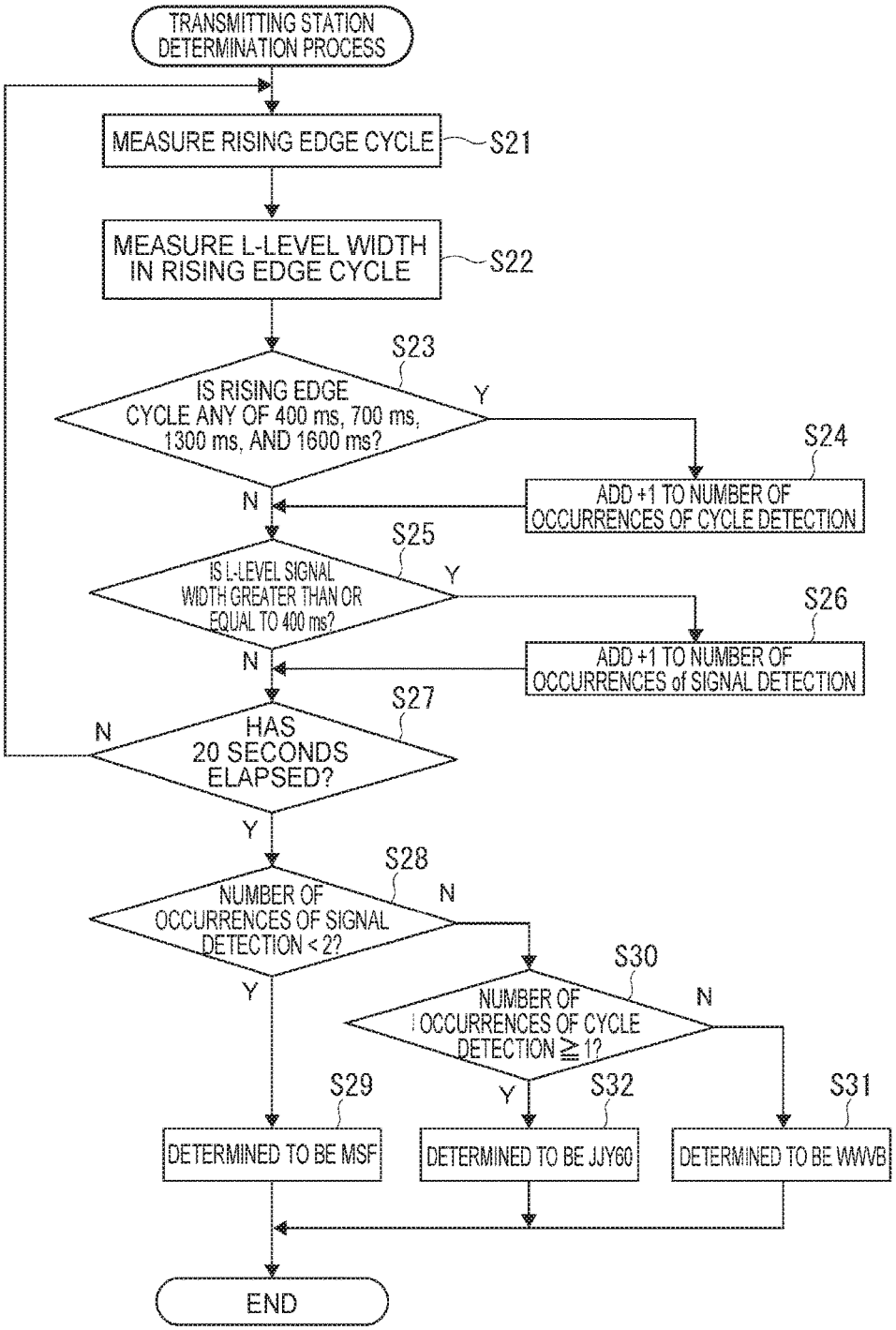
FIG. 17 is a flowchart showing a transmitting station determination process in the second embodiment.

In the flowchart of FIG. 17, the same processes as those in the flowchart of FIG. 3 will be described in a simplified manner.

When the transmitting station determination process is initiated, the rising edge cycle measurement part 714 carries out the process of measuring the rising edge cycle (step S21, which is rising edge cycle measurement step). That is, having detected a rising edge of the demodulated signal, the rising edge cycle measurement part 714 measures the period that elapses until a rising edge is detected next. In the present embodiment, the elapsed period is measured by counting an occurrence of the sampling, and the count value (rising edge cycle) is provided by the F1 counter 721, as in the first embodiment.

The low level width measurement part 712 carries out the process of measuring the low level width in a rising edge cycle (step S22, which is low level width measurement step), as in the first embodiment. That is, the low level width measurement part 712 measures the width (temporal length) where the demodulated signal has the low level in the period from the rising edge detected by the rising edge cycle measurement part 714 to the following rising edge. Also in the present embodiment, the low level width is measured by counting an occurrence of the sampling, and the count value (low level width) is provided by the F2 counter 722.

The rising edge cycle measurement part 714 then determines whether the measured rising edge cycle is any of 400 ms, 700 ms, 1300 ms, and 1600 ms (step S23).

In WWVB, since the demodulated signal falls when each bit of the signal starts, as shown in FIG. 5, the rising edge cycle in WWVB varies in accordance with the type of the code in each bit.

Figure 18:
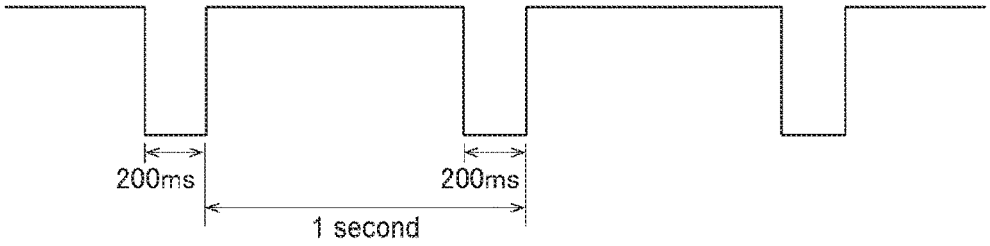
FIG. 18 is a timing chart for describing the rising edge cycle in a case where a code-0 signal and another code-0 signal successively occur in WWVB.
Figure 19:
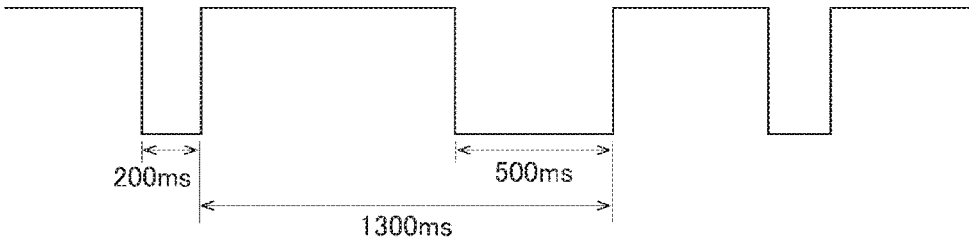
FIG. 19 is a timing chart for describing the rising edge cycle in a case where the code-0 signal and the code-1 signal successively occur in WWVB.
Figure 20:
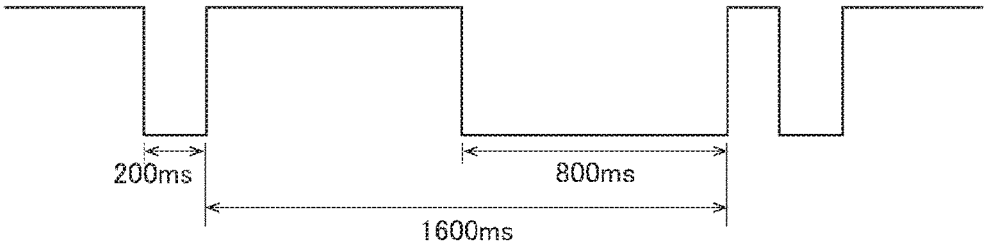
FIG. 20 is a timing chart for describing the rising edge cycle in a case where the code-0 signal and the code-P signal successively occur in WWVB.

For example, when the 200-ms, low-level signal (code-0) successively occurs, the rising edge cycle is 1 second (1000 ms), as shown in FIG. 18. When the 200-ms signal and the 500-ms signal (code-1 signal) successively occur, the rising edge cycle is 1300 ms, as shown in FIG. 19. When the 200-ms signal and the 800-ms signal (code-P signal) successively occur, the rising edge cycle is 1600 ms, as shown in FIG. 20.

Figure 21:
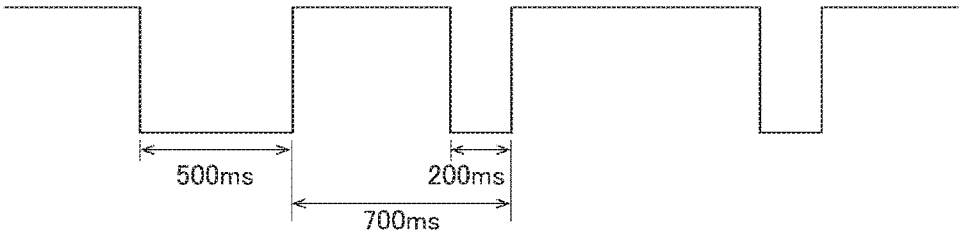
FIG. 21 is a timing chart for describing the rising edge cycle in a case where the code-1 signal and the code-0 signal successively occur in WWVB.
Figure 22:
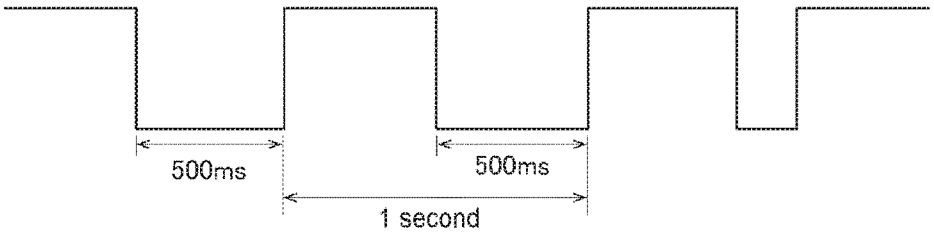
FIG. 22 is a timing chart for describing the rising edge cycle in a case where the code-1 signal and another code-1 signal successively occur in WWVB.
Figure 23:
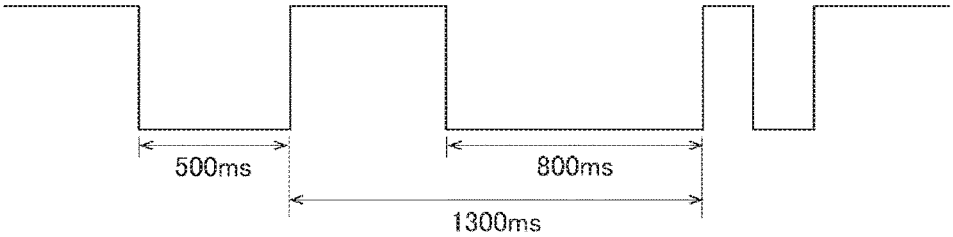
FIG. 23 is a timing chart for describing the rising edge cycle in a case where the code-1 signal and the code-P signal successively occur in WWVB.

When the 500-ms signal and the 200-ms signal successively occur, the rising edge cycle is 700 ms, as shown in FIG. 21. When the 500-ms signal and another 500-ms signal successively occur, the rising edge cycle is 1000 ms, as shown in FIG. 22. When the 500-ms signal and the 800-ms signal successively occur, the rising edge cycle is 1300 ms, as shown in FIG. 23.

Figure 24:
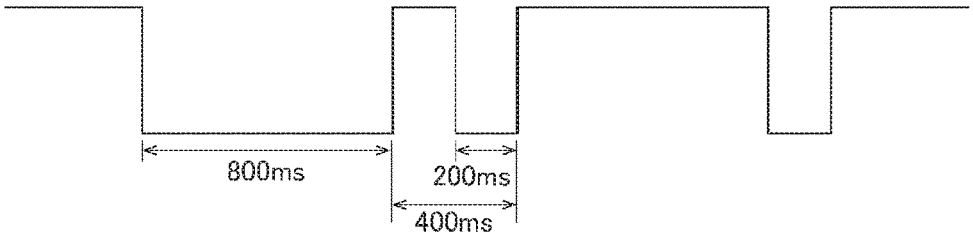
FIG. 24 is a timing chart for describing the rising edge cycle in a case where the code-P signal and the code-0 signal successively occur in WWVB.
Figure 25:
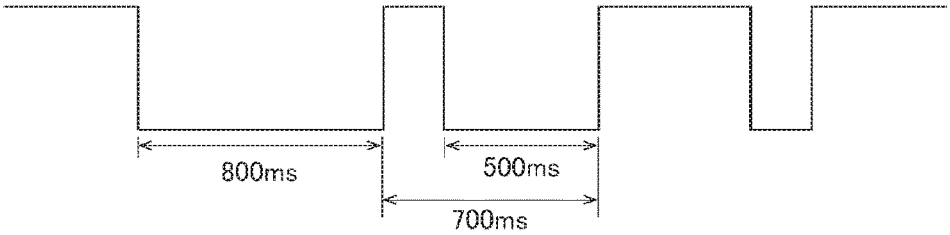
FIG. 25 is a timing chart for describing the rising edge cycle in a case where the code-P signal and the code-1 signal successively occur in WWVB.
Figure 26:
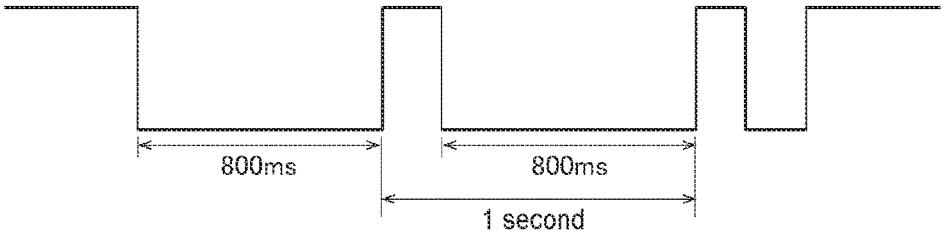
FIG. 26 is a timing chart for describing the rising edge cycle in a case where the code-P signal and another code-P signal successively occur in WWVB.

When the 800-ms signal and the 200-ms signal successively occur, the rising edge cycle is 400 ms, as shown in FIG. 24. When the 800-ms signal and the 500-ms signal successively occur, the rising edge cycle is 700 ms, as shown in FIG. 25. When the 800-ms signal and another 800-ms signal successively occur, the rising edge cycle is 1000 ms, as shown in FIG. 26.

The rising edge cycle that occurs in WWVB is therefore any of 400 ms, 700 ms, 1000 ms, 1300 ms, and 1600 ms.

On the other hand, in JJY60, since the demodulated signal rises when each bit of the signal starts, the rising edge occurs at 1-second intervals, as shown in FIG. 4. The rising edge cycle in JJY60 is therefore 1 second (1000 ms).

In MSF, since the demodulated signal falls when each bit of the signal starts, as shown in FIG. 6, the rising edge cycle varies in accordance with the code in each bit, as in WWVB. Although not shown, the rising edge cycle so varies as to take values of 600 ms, 700 ms, 800 ms, 900 ms, 1000 ms, 1100 ms, 1200 ms, and 1400 ms as well as 1 second (in a case where the same code successively occurs).

Therefore, in a case where WWVB or MSF is received, a rising edge cycle of any of 400 ms, 700 ms, 1300 ms, and 1600 ms is detected in some cases. In this case, the rising edge cycle measurement part 714 determines the result of step S23 to be Yes and adds +1 to the count value of the M1 counter 723, which counts an occurrence of the cycle detection (step S24).

On the other hand, since the rising edge cycle is 1 second in the case where the same code successively occurs in WWVB and MSF and in the case where JJY60 is received, the rising edge cycle measurement part 714 determines the result of step S23 to be "No" and does not update the M1 counter 723.

Also in the case where MSF is received and a rising edge cycle other than 400 ms, 700 ms, 1300 ms, and 1600 ms (600 ms, 800 ms, 900 ms, 1100 ms, 1200 ms, and 1400 ms, for example) is detected, the rising edge cycle measurement part 714 determines the result of step S23 to be "No" and does not update the M1 counter 723.

Therefore, during the reception of MSF, the M1 counter 723 shows 0 in some cases and at least 1 in other cases. No problem, however, occurs because it can be determined that MSF is being received by comparison of the low level width with the threshold 400 ms during the 20-second reception and evaluation of whether the count of occurrences in which a signal having a low level width greater than or equal to 400 ms is detected is fewer than 2, as in the first embodiment, and the count of occurrences of the rising edge cycle detection is not used in the determination of whether MSF is being received.

The low level width measurement part 712 then evaluates whether the low level width measured in the rising edge cycle is greater than or equal to a threshold set in advance (step S25). The threshold is set at the same value as that in the first embodiment (400 ms). The low level width measurement part 712 can therefore evaluate whether the measured low level width is greater than or equal to 400 ms or smaller than 400 ms, as in the first embodiment. Therefore, in the case where the code P or the code 1 in JJY60 or WWVB, which is a signal having a low level width greater than or equal to 500 ms, is received and in the case where the code M in MSF is received, the low level width measurement part 712 determines the result of step S25 to be "Yes" and adds +1 to the count value of the M2 counter 724 (step S26).

On the other hand, in the case where a bit carrying the code 0 is received in JJY60 or WWVB and in the case where a bit carrying a code other than the code M is received in MSF, a signal having a low level width smaller than or equal to 300 ms is detected, and the detected low level width is smaller than 400 ms. The low level width measurement part 712 therefore determines the result of step S25 to be "No" and does not update the M2 counter 724.

The rising edge cycle measurement part 714 then evaluates whether or not the rising edge cycle has lasted for 20 seconds (step S27), as in the first embodiment.

When a result of the evaluation in step S27 is No, the rising edge cycle measurement part 714 repeats the processes in steps S21 to S27.

When a result of the evaluation in step S27 is "Yes," the determination part 713 carries out the process of determining the type of the radio wave being received (transmitting station).

That is, the determination part 713 first evaluates whether the counter value of the M2 counter 724 is fewer than "2" (step S28). When the counter value of the M2 counter 724 is fewer than "2", the determination part 713 determines that the station from which the radio wave is being received is an MSF station (step S29) as in the first embodiment.

On the other hand, in the case of JJY60 and WWVB, when the code P or the code 1 is received, the low level width is greater than or equal to 400 ms, and the M2 counter 724 counts up, as in the first embodiment. A result of the evaluation in step S28 is therefore "No." The determination 713 then evaluates whether the counter value of the M1 counter 723 is greater than or equal to "1", which is the threshold (step S30).

At this point, the M1 counter 723 shows the count of occurrences in which the interval between rising edges of the signal has been determined to be any of 400 ms, 700 ms, 1300 ms, and 1600 ms. Therefore, when a JJY60 signal, which falls when each bit starts, is received, the rising edge cycle is 1000 ms, and the M1 counter 723 does not count up so that the count value thereof remains "0". Therefore, when a result of the evaluation in step S30 is "No," that is, the counter value of the M1 counter 723 (count of occurrences of cycle detection) is "0", the determination part 713 determines that the station from which the radio wave is being received is a JJY60 station (step S31).

On the other hand, in the case of WWVB, in which the rising edge cycle varies in accordance with the code carried by each bit, the rising edge cycle is 1000 ms in some cases and is any of 400 ms, 700 ms, 1300 ms, and 1600 ms in other cases. In particular, since any of 400 ms, 700 ms, 1300 ms, and 1600 ms is necessarily present in the 20-second measurement period or in a longer measurement period, the counter value of the M1 counter 723 is greater than or equal to "1". Therefore, when a result of the evaluation in step S30 is "Yes," that is, the counter value of the M1 counter 723 (count of occurrences of cycle detection) is greater than or equal to "1", the determination part 713 determines that the station from which the radio wave is being received is a WWVB station (step S32).

The type determination part 710A, which carries out the processes described above, determines the type of a received radio wave, that is, a standard radio wave frequency station. Table 2 shows the counter value of the M1 counter 723, which counts an occurrence in which the rising edge cycle is determined to be any of 400 ms, 700 ms, 1300 ms, and 1600 ms, the counter value of the M2 counter 724, which counts an occurrence in which the low level width is greater than or equal to the predetermined threshold (400 ms), and methods for the determination.

TABLE 2

| Transmitting station | Value of M1 counter | Value of M2 counter | Determination method |
|---|---|---|---|
| MSF | 0 or at least 1 | Fewer than 2 (for 20 seconds) | The count of occurrences in which L-level width is detected is fewer than 2 |
| JJY60 | 0 | At least 2 (for 20 seconds) | The count of occurrences in which cycle is detected is 0 and the count of occurrences in which L-level width is detected is at least 2 |
| WWVB | At least 1 | At least 2 (for 20 seconds) | The count of occurrences in which cycle is detected is at least 1 and the count of occurrences in which L-level width is detected is at least 2 |

Advantageous Effects Provided by Second Embodiment

The second embodiment described above can provide the same advantageous effects as those provided by the first embodiment described above.

That is, the type determination part 710A, which simply receives a signal that lasts for the measurement period set in advance (longer than or equal to 20 seconds but shorter than or equal to 60 seconds), can determine which of the three types of radio wave having the same frequency (60 kHz) the radio wave being received belongs to. The processing period required for determination of the type of the received radio wave can therefore be shortened. That is, the measurement period set at 20 seconds at the shortest allows determination of the transmitting station, whereby the transmitting station can be determined in a short period.

Further, since the low level width measurement part 712 determines whether the count of occurrences in which a measured low level width is greater than or equal to the predetermined threshold (400 ms, for example) is fewer than "2" or greater than or equal to "2", MSF can be precisely distinguished from JJY60 and WWVB.

Further, since the threshold used in the low level width measurement part 712 is set at 400 ms, the determination can be precisely made even when the low level width of each signal varies to some extent due, for example, to noise. As a result, an MSF station can be accurately determined to be the transmitting station, whereby the reception sensitivity can be maintained.

Further, in the case where WWVB is received, among the cycles to be evaluated by the rising edge cycle measurement part 714, even the cycle closest to 1000 ms, which is the rising edge cycle of JJY60, is 700 ms or 1300 ms, which differs from 1000 ms by as large as 300 ms, whereby the rising edge cycle measurement part 714 does not determine the rising edge cycle to be 700 ms or 1300 ms even when the rising edge cycle varies due, for example, to noise as long as the JJY60 standard radio wave is received. Therefore, when the rising edge cycle measurement part 714 determines that the count of occurrences in which any of 400 ms, 700 ms, 1300 ms, and 1600 ms is detected is at least one, it can be accurately determined that JJY60 is not being received.

The combination of the determination based on the rising edge cycle and the determination based on the low level width described above therefore allows precise determination between JJY60 and WWVB. That is, since the transmitting station is not determined by the number of 1-second falling edge cycles, which is present in every transmitting station, but is determined by the rising edge cycle not present in JJY60 but present in WWVB, the transmitting station can be accurately determined, and the probability of wrong determination is small, whereby the reception sensitivity can be maintained.

In the second embodiment, since the type of a radio wave can be determined only by measuring the rising edge cycle and the low level width of a received signal, updating the counter values of the counters 721 to 724, and evaluating the counter values, whereby no complicated calculation process is required.

Therefore, since the process of determining the type of a radio wave can be carried out in a short period and simplified, power consumption required for the determination process can be lowered, and hence the power consumed by the radio wave correction timepiece 1 can be lowered.

In each of the measurement of the cycle of the rising edge interval performed by the rising edge cycle measurement part 714 and the measurement of the low level width performed by the low level width measurement part 712, the length of a period is measured by counting an occurrence of the sampling, whereby the period can be measured more readily than in a case where a timer or any other tool is used.

Other Embodiments

The invention is not limited to the embodiments described above, and changes, improvements, and other modifications to the extent that the advantage of the invention is achieved fall within the scope of the invention.

For example, in the first embodiment described above, in steps S8 to S11 in FIG. 3, the transmitting station is determined to be an MSF transmitting station in the case where the count of occurrences of the signal detection is fewer than 2, the transmitting station is determined to be a JJY60 transmitting station in the case where the count of occurrences of the signal detection is at least 2 and the count of occurrences of the cycle detection is at least 1, and the transmitting station is determined to be a WWVB transmitting station in the case where the count of occurrences of the signal detection is at least 2 and the count of occurrences of the cycle detection is 0.

In contrast, since the count of occurrences in which a detected falling edge cycle is any of 400 ms, 700 ms, 1300 ms, and 1600 ms is 0 in MSF as well as in WWVB, as described above, the transmitting station may be determined to be an MSF transmitting station in a case where the count of occurrences of the signal detection is fewer than 2 and the count of occurrences of the cycle detection is 0.

Further, in the first embodiment, the transmitting station may be determined to be a JJY60 transmitting station in a case where the count of occurrences of the cycle detection is at least 1, the transmitting station may be determined to be an MSF transmitting station in a case where the count of occurrences of the cycle detection is 0 and the count of occurrences of the signal detection is 0, and the transmitting station is a WWVB transmitting station in a case where the count of occurrences of the cycle detection is 0 and the count of occurrences of the signal detection is at least 2.

In the second embodiment, in which the rising edge cycle is detected for the determination, in steps S28 to S31 in FIG. 17, the transmitting station is determined to be an MSF transmitting station in the case where the count of occurrences of the signal detection is fewer than 2, the transmitting station is determined to be a WWVB transmitting station in the case where the count of occurrences of the signal detection is at least 2 and the count of occurrences of the cycle detection is at least 1, and the transmitting station is determined to be a JJY60 transmitting station in the case where the count of occurrences of the signal detection is at least 2 and the count of occurrences of the cycle detection is 0.

In contrast, it may first be evaluated whether the count of occurrences of the cycle detection is 0 or at least 1, and it may then be evaluated whether the count of occurrences of the signal detection is fewer than 2 to determine the type of a standard radio wave.

In the first embodiment described above, the count of occurrences in which the falling edge cycle is 1000 ms may be separately counted. In WWVB and MSF, since the falling edge cycle should be 1000 ms, evaluating whether the count of occurrences of the detection is greater than or equal to a threshold according to the measurement period allows determination of the environment in question to be an environment suitable for radio wave reception. For example, when the measurement period is 20 seconds, the count of occurrences in which the falling edge cycle is 1 second should be 20 in WWVB and MSF. Therefore, when the threshold, for example, at 18 and the count is greater than or equal to the threshold, it can be determined that the radio wave is received in a satisfactory environment where only a small amount of noise or any other influence is present.

Further, in JJY60, the sum of the count value of the M1 counter 723 and the count of occurrences in which the falling edge cycle is 1 second should be 20, and when the sum is greater than or equal to a threshold (18, for example), it is determined that the radio wave is received in a satisfactory environment where only a small amount of noise or any other influence is present.

Similarly, in the second embodiment described above, the count of occurrences in which the rising edge cycle is 1000 ms may be separately counted. In JJY60, since the rising edge cycle should be 1000 ms, evaluating whether the count of occurrences of the detection is greater than or equal to a threshold according to the measurement period allows determination of the environment in question to be an environment suitable for radio wave reception.

Further, in WWVB, the sum of the count value of the M1 counter 723 and the count of occurrences in which the rising edge cycle is 1 second should be 20. Therefore, when the sum is greater than or equal to a threshold (18, for example), it can be determined that the radio wave is received in a satisfactory environment where only a small amount of noise or any other influence is present.

In MSF, since rising edge cycles other than 400 ms, 700 ms, 1300 ms, and 1600 ms are present, as described above, the other cycles may be detected, the sum of occurrences of the detection of each of the other cycles may be determined, and the sum may be compared with a threshold for evaluation of the reception environment.

In each of the embodiments described above, the type of a standard radio wave is determined to be any of the three types of 60-kHz standard radio waves, JJY60, WWVB, and MSF. For example, in FIGS. 3 and 17, the processes in steps S10 to S12 and steps S30 to S32 may be omitted, and the determination part 713 may be configured to evaluate whether or not a received standard radio wave is MSF. In this case, the type determination parts 710 and 710A may not be provided with the falling edge cycle measurement part 711 or the rising edge cycle measurement part 714. However, the type determination parts 710 and 710A provided with the falling edge cycle measurement part 711 and the rising edge cycle measurement part 714 can also advantageously be used in a radio wave correction timepiece 1 required to determine whether a received radio wave is JJY60 or WWVB.

Further, the determination part 713 may be configured to evaluate only whether or not a received standard radio wave is WWVB or may be configured to evaluate only whether or not a received standard radio wave is JJY60.

Moreover, the determination part 713 may be configured to evaluate two types of standard radio waves, WWVB and MSF, may be configured to evaluate two types of standard radio waves, WWVB and JJY60, or may be configured to evaluate two types of standard radio waves, JJY60 and MSF. Any of the configurations described above may be set in accordance with the specifications of the radio wave correction timepiece 1.

In each of the embodiments described above, the frequency used to sample the demodulated signal is not limited to 64 Hz. For example, the frequency may be 32 Hz or 128 Hz. That is, the rising edge, the falling edge, and the low level width of the demodulated signal only need to be appropriately measured.

Further, the condition under which the rising edge cycle is determined to be any of 400 ms, 700 ms, 1300 ms, and 1600 ms and the condition under which the low level width is determined to be greater than or equal to the threshold (400 ms) (count of occurrences of sampling) are not limited to those in the embodiments described above.

In each of the embodiments described above, the threshold of the low level signal width is not limited to 400 ms and may, for example, be 350 ms or 450 ms. In short, any threshold that allows a signal having a low level signal width smaller than or equal to 300 ms and a signal having a low level signal width greater than or equal to 500 ms to be distinguished from each other.

In each of the embodiments described above, the measurement period is 20 seconds, but the measurement period is not limited to 20 seconds. Since the requirement of the measurement period is that the code M in MSF is received only once at the maximum, the measurement period can be set at a value within the range longer than or equal to 20 seconds but shorter than 60 seconds. To lower power consumed by the reception, however, it is most preferable to set the measurement period at 20 seconds, which is the shortest measurement period.

In the embodiments described above, the antenna 2, the reception circuit 3, and the controller 4 (reception processing part 71, in particular), which form the time information receiver 20 according to the embodiment of the invention, are employed in the radio wave correction timepiece 1 by way of example, but not necessarily in the invention. For example, the invention may be applied to a recording apparatus that performs timer recording and a timepiece built in a mobile phone and other similar apparatus.

The entire disclosure of Japanese Patent Application No. 2016-035864, filed Feb. 26, 2016 is expressly incorporated by reference herein.

What is claimed is:

1. A time information receiver that receives a standard radio wave containing a time code and analyzes the time code based on a demodulated signal of the standard radio wave, the receiver comprising:

a falling edge cycle measurement part that measures a falling edge cycle of the demodulated signal over a measurement period set in advance and counts an occurrence in which the falling edge cycle is determined to coincide with any of 400 ms, 700 ms, 1300 ms, and 1600 ms;

a low level width measurement part that measures a low level width over the measurement period whenever the falling edge cycle of the demodulated signal occurs and counts an occurrence in which the measured low level width is greater than or equal to a predetermined threshold greater than 300 ms but smaller than 500 ms; and a determination part that determines a transmitting station that transmits the standard radio wave, wherein when a result of the measurement performed by the low level width measurement part is fewer than 2, the determination part determines that the transmitting station that transmits the standard radio wave is an MSF station.

2. A time information receiver that receives a standard radio wave containing a time code and analyzes the time code based on a demodulated signal of the standard radio wave, the receiver comprising:

a falling edge cycle measurement part that measures a falling edge cycle of the demodulated signal over a measurement period set in advance and counts an occurrence in which the falling edge cycle is determined to coincide with any of 400 ms, 700 ms, 1300 ms, and 1600 ms;

a low level width measurement part that measures a low level width over the measurement period whenever the falling edge cycle of the demodulated signal occurs and counts an occurrence in which the measured low level width is greater than or equal to a predetermined threshold greater than 300 ms but smaller than 500 ms; and a determination part that determines a transmitting station that transmits the standard radio wave, wherein when a result of the measurement performed by the falling edge cycle measurement part is at least 1, the determination part determines that the transmitting station that transmits the standard radio wave is a JJY60 station.

3. A time information receiver that receives a standard radio wave containing a time code and analyzes the time code based on a demodulated signal of the standard radio wave, the receiver comprising:

a falling edge cycle measurement part that measures a falling edge cycle of the demodulated signal over a measurement period set in advance and counts an occurrence in which the falling edge cycle is determined to coincide with any of 400 ms, 700 ms, 1300 ms, and 1600 ms;

a low level width measurement part that measures a low level width over the measurement period whenever the falling edge cycle of the demodulated signal occurs and counts an occurrence in which the measured low level width is greater than or equal to a predetermined threshold greater than 300 ms but smaller than 500 ms; and a determination part that determines a transmitting station that transmits the standard radio wave, wherein when a result of the measurement performed by the falling edge cycle measurement part is 0, and a result of the measurement performed by the low level width measurement part is at least 2, the determination part determines that the transmitting station that transmits the standard radio wave is a WWVB station.

4. A radio wave correction timepiece comprising:

the time information receiver according to claim 1;

a time correction part that corrects internal time based on time data acquired by the time information receiver; and a display part that displays the corrected internal time.

5. A radio wave correction timepiece comprising:

the time information receiver according to claim 2;

a time correction part that corrects internal time based on time data acquired by the time information receiver; and a display part that displays the corrected internal time.

6. A radio wave correction timepiece comprising:

the time information receiver according to claim 3;

a time correction part that corrects internal time based on time data acquired by the time information receiver; and a display part that displays the corrected internal time.

* * * * *